US008163451B2

(12) United States Patent
Hirose et al.

(10) Patent No.: US 8,163,451 B2
(45) Date of Patent: Apr. 24, 2012

(54) ELECTROSTATIC LATENT IMAGE DEVELOPING TONER AND METHOD OF IMAGE FORMING

(75) Inventors: Naohiro Hirose, Tokyo (JP); Meizo Shirose, Tokyo (JP); Hiroyuki Yasukawa, Tokyo (JP); Shiro Hirano, Tokyo (JP); Tatsuya Fujisaki, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 431 days.

(21) Appl. No.: 12/468,126

(22) Filed: May 19, 2009

(65) Prior Publication Data

US 2009/0291382 A1 Nov. 26, 2009

(30) Foreign Application Priority Data

May 22, 2008 (JP) ..... 2008-134059

(51) Int. Cl.
*G03G 9/08* (2006.01)

(52) U.S. Cl. ..... 430/108.21; 430/108.4; 430/108.8

(58) Field of Classification Search ..... 430/108.21, 430/108.4, 108.8
See application file for complete search history.

(56) References Cited

U.S. PATENT DOCUMENTS

2003/0116017 A1* 6/2003 Pozarnsky et al. ..... 95/149
2006/0210909 A1* 9/2006 Ohtani ..... 430/137.1

FOREIGN PATENT DOCUMENTS

JP 200864940 3/2008

* cited by examiner

*Primary Examiner* — Mark A Chapman

(74) *Attorney, Agent, or Firm* — Lucas & Mercanti, LLP

(57) ABSTRACT

An electrostatic latent image developing toner comprising at least a resin, a wax and a colorant, wherein the wax comprises 40 to 98% by mass of a first release agent comprising an ester wax and 2 to 60% by mass of a second release agent comprising a hydrocarbon having at least one of a branched chain structure and a cyclic structure; and the colorant comprises a silicon phthalocyanine represented by Formula (I):

Formula (I)

12 Claims, 3 Drawing Sheets

ELECTROSTATIC LATENT IMAGE DEVELOPING TONER AND METHOD OF IMAGE FORMING

This application is based on Japanese Patent Application No. 2008-134059 filed on May 22, 2008 in Japanese Patent Office, the entire content of which is hereby incorporated by reference.

FIELD OF THE INVENTION

The present invention relates to an electrostatic latent image developing toner employed for electrophotographic image formation, and more specifically to a toner providing an image exhibiting a wide hue range, high transparency, and an excellent separation property at the time of fixing. In particular, the present invention relates to an electrostatic latent image developing toner exhibiting an excellent separation property at the time of fixing, as well as sufficiently suppressed document offset, and to a method of image forming employing the toner.

BACKGROUND OF THE INVENTION

In the method of forming electrophotographic images employing an electrostatic latent image developing toner (hereinafter, simply referred to as a toner), an electrostatic latent image corresponding to a pattern of the original document (that is, image information of the original document) is formed by irradiating image-wise light on a photoreceptor, after which the resulting latent image is developed with a toner to form an image.

In particular, in recent years, color images have been widely used. In case of the color images, a method has been practically used such that a toner image composed of individual elementary colors is formed by developing the electrostatic latent images corresponding the respective elementary colors employing corresponding color toners, followed by superposing the above elementary color images. Color toners for forming above-described color image include a yellow toner, a magenta toner, a cyan toner and a black toner, each of which contains a binding resin (a binder resin) which is a thermoplastic resin and a colorant of each color.

Namely, the method of forming electrophotographic images is described as follows. In general, an electrostatic latent image is formed by irradiating a photoreceptor with light having image information of the original document via various methods on a photoreceptor having a light conductive material, and the resulting electrostatic latent image formed on the photoreceptor is developed by a charged toner to form a toner image, which is then transferred to an image transper material (for example, a plain paper, or intermediate transfer body), to obtain a final visual image through a fixing step employing a heat fixing device.

In order to form a full color image, the image information of the original image is decomposed into image patterns of yellow, magenta, cyan and black. A latent image of each of the yellow, magenta, cyan and black image patterns is formed on a photoreceptor, which is then developed with a toner of corresponding color.

As a colorant constituting a toner, commonly known organic pigments and oil soluble dyes have been employed, and toners in which either an organic pigment or an oil soluble dye is employed, or toners in which mixture of an organic pigment and an oil soluble dye is employed, have been proposed. However, each of the organic pigment and the oil soluble dye, both of which are employed as the colorants, has various problems.

Specifically, the organic pigment generally exhibits excellent heat resistance and light stability compared to the oil soluble dye, but exhibit a problem such that, since the organic pigment exist in a toner as dispersed particles, the organic pigment exhibits strong hiding power resulting in decrease in transparency of a toner. Further, since the pigment exhibits a low dispersibility, the low dispersibility of the pigment results in further lower transparency, lower color saturation and a poor color reproducibility in the formed toner images.

In particular, in a full-color image which is formed by superposing toner images of each single color, since an image in the lowest layer of the superposed toner images is hidden by images in the upper layers, the aforesaid toner image in the lowest layer tends to be less-visible and unclear. In order to prevent the above problem, the toner of each color is desired exhibit transparency in the fixed state, and therefore, in order to obtain excellent color reproduction, colorants constituting the toner are desired to exhibit high dispersibility.

In the field of printers, along with the recent progress in electrophotographic method, a method of forming electrophotographic images employing a toner have been widely used. In addition to conventional monochrome prints represented by document preparation, full-color prints have, in recent years, become widely. Since such a full-color image forming apparatus can make on demand as many prints as necessary without making proofs as in printing industry, full-color image forming apparatuses have been widely utilized in the light-printing field which has many opportunities to take orders of a small amount of prints (for example, refer to Patent Document 1).

In particular, in order to make full-color prints, such as catalogues and advertisements employing toners, toners used for the prints are desired to exhibit excellent color reproduction so as to provide images faithful to the original images. In order to realize it, various colorants have been studied for the purpose of improving color reproduction of color toners.

For example, as a cyan colorant, colorants having a structure of a primary framework of copper phthalocyanine have been widely employed, but these colorants tend to exhibit inferior in color saturation. As a cyan colorant exhibiting high color saturation, squarelium compounds have been known, but these compounds exhibited poor separation properties at the time of fixing, and image defects due to wax unevenness even when prints are normally discharged. Also squarelium compounds tend to exhibit document offsetting.

Patent Document 1: Japanese Patent Application Publication No. 2008-64940

SUMMARY OF THE INVENTION

It is an object of the present invention to provide an electrostatic latent image developing toner which provides a full-color image which exhibits high color saturation with a clear and brilliant color tone, and forms stable full-color images of high quality. In particular, it is an object to provide a method for forming an image exhibiting no image unevenness, an excellent separation property at the time of fixing, as well as suppressed document offsetting, and to provide an electrostatic latent image developing toner enabling the above method.

One of the aspects of the present invention to achieve the above object is an electrostatic latent image developing toner comprising at least a resin, a wax and a colorant, wherein the wax comprises 40 to 98 W by mass of a first release agent comprising an ester wax and 2 to 60% by mass of a second release agent comprising a hydrocarbon having at least one of a branched chain structure and a cyclic structure; and the colorant comprises a silicon phthalocyanine represented by Formula (I):

Formula (I)

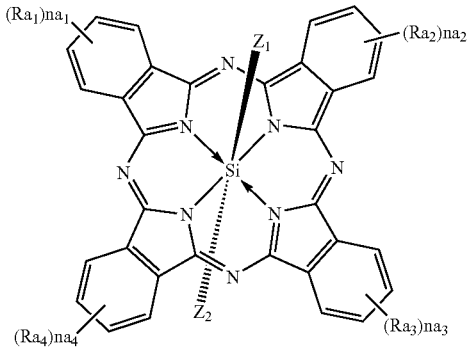

wherein $Z_1$ and $Z_2$ each independently represent a hydroxyl group, a chlorine atom, an aryloxy group of 6 to 18 carbon atoms, an alkoxyl group of 1 to 22 carbon atoms or a group represented by Formula (IV); $Ra_1$, $Ra_2$, $Ra_3$ and $Ra_4$ each independently represent a substituent; and $na_1$, $na_2$, $na_3$ and $na_4$ each independently represent an integer of 0 to 4, Formula (IV)

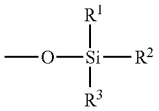

wherein $R^1$, $R^2$ and $R^3$ each represent an alkyl group of 1 to 22 carbon atoms, an aryl group of 6 to 18 carbon atoms, an alkoxyl group of 1 to 22 carbon atoms or an aryloxy group of 6 to 18 carbon atoms, wherein $R^1$, $R^2$ and $R^3$ each may be the same or different.

DESCRIPTION OF THE PREFERRED EMBODIMENTS

Figure 1:
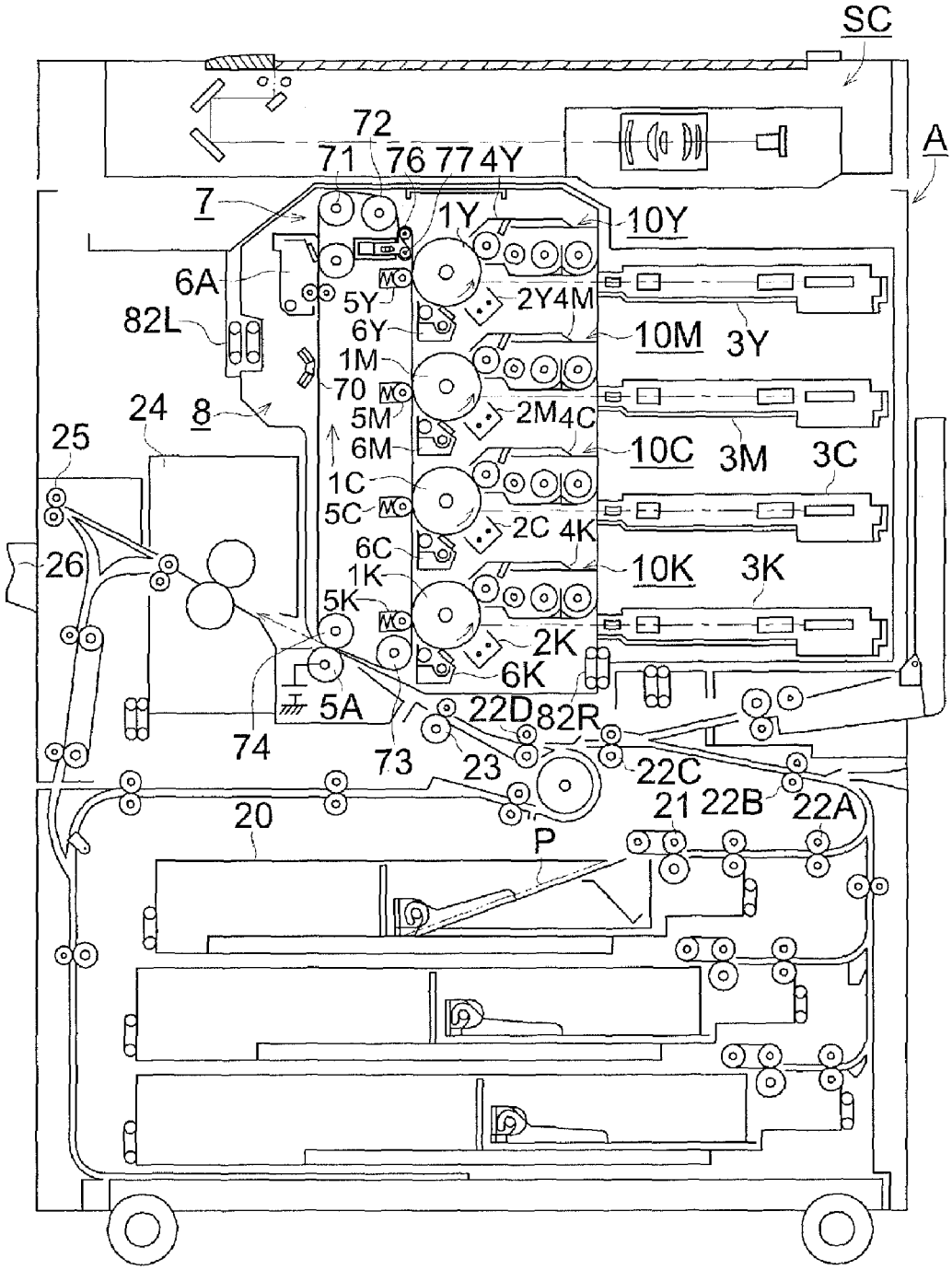
FIG. 1 is a schematic view showing an example of a tandem type full-color image forming apparatus capable of image formation of a double-component developing system

The above object of the present invention is achieved by the following structure:

(1) An electrostatic latent image developing toner comprising at least a resin, a wax and a colorant, wherein the wax comprises 40 to 98% by mass of a first release agent comprising an ester wax and 2 to 60% by mass of a second release agent comprising a hydrocarbon having at least one of a branched chain structure and a cyclic structure; and the colorant comprises a silicon phthalocyanine represented by Formula (I):

Formula (I)

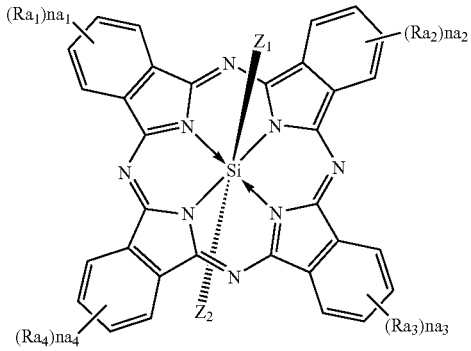

wherein $Z_1$ and $Z_2$ each independently represent a hydroxyl group, a chlorine atom, an aryloxy group of 6 to 18 carbon atoms, an alkoxyl group of 1 to 22 carbon atoms or a group represented by Formula (IV); $Ra_1$, $Ra_2$, $Ra_3$ and $Ra_4$ each independently represent a substituent; and $na_1$, $na_2$, $na_3$ and $na_4$ each independently represent an integer of 0 to 4, Formula (IV)

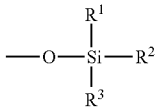

wherein $R^1$, $R^2$ and $R^3$ each represent an alkyl group of 1 to 22 carbon atoms, an aryl group of 6 to 18 carbon atoms, an alkoxyl group of 1 to 22 carbon atoms or an aryloxy group of 6 to 18 carbon atoms, wherein $R^1$, $R^2$ and $R^3$ each may be the same or different.

(2) The electrostatic latent image developing toner of Item (1), wherein $Z_1$ and $Z_2$ each independently represent a group represented by Formula (IV).

(3) The electrostatic latent image developing toner of Item (2), wherein $R^1$, $R^2$ and $R^3$ each are a methyl group.

(4) The electrostatic latent image developing toner of any one of Items (1) to (3), wherein a content of the wax is 4 to 25% by mass based on a total mass of the resin, the colorant and the wax.

(5) The electrostatic latent image developing toner of any one of Items (1) to (4), wherein a content of the silicon phthalocyanine is 1 to 20% by mass based on a total mass of the electrostatic latent image developing toner.

(6) The electrostatic latent image developing toner of any one of Items (1) to (5), wherein the content of the silicon phthalocyanine is 1 to 10% by mass based on the total mass of the electrostatic latent image developing toner.

(7) The electrostatic latent image developing toner of any one of Items (1) to (6), wherein the content of the silicon phthalocyanine is 1 to 7% by mass based on the total mass of the electrostatic latent image developing toner.

(8) The electrostatic latent image developing toner of any one of Items (1) to (7) comprising two or more kinds of silicon phthalocyanine.

(9) The electrostatic latent image developing toner of any one of Items (1) to (8), wherein the wax comprises 60 to 95% by mass of the first release agent and 5 to 40% by mass of the second release agent.

(10) The electrostatic latent image developing toner of any one of Items (1) to (9), wherein a ratio of branch of the hydrocarbon having the branched chain structure is 0.1 to 20%.

(11) The electrostatic latent image developing toner of any one of Items (1) to (10), wherein a ratio of branch of the hydrocarbon having the branched chain structure is 0.3 to 10%.

(12) A method of image forming comprising the steps of:

forming an electrostatic latent image on a photoreceptor;

forming a toner image by developing the electrostatic latent image formed on the photoreceptor by employing a developer which is prepared by incorporating the electrostatic latent image developing toner of any one of Items (1) to (11);

transferring the toner image formed on the photoreceptor onto a transfer body; and fixing the toner image transferred onto the transfer body, wherein a fixing device employing a contact heating method is used in the fixing step.

In the present invention, it was found that the object of the present invention can be achieved without causing the above-described problems by employing a combination of a first releasing agent containing an ester compound which will be described later, and a second releasing agent containing a hydrocarbon compound having a branched chain structure and/or a cyclic structure, and further employing a silicon phthalocyanine compound represented by Formula (I), as a colorant.

It is assumed that the above results would be an effect of an interaction between the above wax in a toner and the silicon phthalocyanine compound represented by Formula (I). Silicon phthalocyanine compounds other than those represented by Formula (I) exhibit no such phenomenon. It is assumed that the above interaction is an effect arising from an increase in the rate of oozing out of the wax onto the surface of a toner particle during fixing of the toners, of where the above increase is due to the adoption of the constitution of the present invention, and further, polarity and the molecular structure of the silicon phthalocyanine compound function as a dispersion aid for the mixed wax.

The present invention provides an electrostatic latent image developing toner which enables to form stable and high quality full-color images exhibiting high color saturation and a clear and brilliant color tone, and, specifically provides a method for forming images exhibiting no image unevenness, excellent separation properties at the time of fixing, as well as suppressed document offsetting while being stacked when stored, and an electrostatic latent image developing toner enabling the above method.

The compounds and methods for forming images employed in the present invention will be described in detail below.

The silicon phthalocyanine compounds represented by Formula (I) could provide cyan toners exhibiting excellent hue and high color saturation, but had a problem of poor fixing separation properties. However, when the silicon phthalocyanine compound was used in combination with a component of the first releasing agent comprising an ester compound and the second releasing agent comprising a hydrocarbon compound having a branched chain structure and/or a cyclic structure, the fixing separation property was significantly improved, although a combination of a silicon phthalocyanine compound and a single wax, which was conventionally carried out, have not exhibit any significant effect.

As described above, the above result seems to be an effect of the interaction between the above waxes and the silicon phthalocyanine compound represented by Formula (I) in the toner, and it is assumed that it arose from an increase in the rate of oozing out of waxes onto the surface of a toner particle during fixing of the toners. The reason for that is still unclear, but it is assumed that polarity and the molecular structure of the silicon phthalocyanine compound function as a dispersion aid for the mixed wax.

It is assumed that the ester group tends to be oriented to the skeleton having a silicon atom group in the center, and the hydrocarbon based wax tends to orient around the skeleton, and due to the effect the above orientations, dispersibility of waxes was improved. It seems that the surface state of printed images was changed by the above effect, whereby adhesiveness of the toner to the stacked paper sheet due to heat and pressure was reduced even when finished images were stacked and stored. As a result, an unexpected effect was obtained in that the document offsetting was drastically suppressed.

It was found in the present invention that the above problems could be overcome when a mixed releasing agent, containing a component of the first releasing agent in an amount of 40 to 98% by mass in which a wax contained an ester compound and a component of the second releasing agent in an amount of 2 to 60% by mass, which contained a hydrocarbon compound exhibiting a branched chain structure and/or a cyclic structure, was employed in combination with the silicon phthalocyanine of Formula (I). Thus the inventors have achieved the present invention.

The ratio by mass of the waxes, to the total amount of resin of an electrostatic latent image developing toner, colorant and waxes, is preferably 4 to 25%, and more preferably 6 to 20%.

[Silicon Phthalocyanine]

As described above, the toner employed in the present invention incorporates at least a resin and a colorant, and further incorporates a compound represented by the following formula. The compound represented by Formula (I) employs a silicon atom (Si) as a metal atom located at the center of the phthalocyanine ring (hereinafter also referred to as a center metal atom).

Specifically, the above compound exhibits the structure below.

Formula (I)

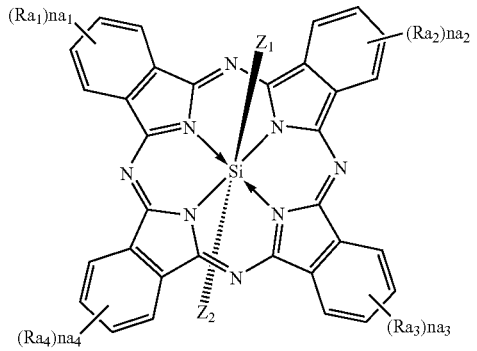

wherein $Z_1$ and $Z_2$ each independently represent a hydroxyl group, a chlorine atom, an aryloxy group of 6 to 18 carbon atoms, an alkoxyl group of 1 to 22 carbon atoms or a group represented by Formula (IV); $Ra_1$, $Ra_2$, $Ra_3$ and $Ra_4$ each independently represent a substituent; and $na_1$, $na_2$, $na_3$ and $na_4$ each independently represent an integer of 0 to 4.

Examples of a substituent represented by $Ra_1$, $Ra_2$, $Ra_3$ or $Ra_4$ include an alkyl group (for example, a methyl group, a trifluoromethyl group and an ethyl group), a halogen atom (for example, F, Cl and Br), a sulfo group. Of these, preferable substituents include a methyl group, a chlorine atom, a trifluoromethyl group and a sulfo group.

Formula (IV)

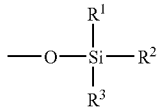

wherein $R^1$, $R^2$ and $R^3$ each represent an alkyl group of 1 to 22 carbon atoms, an aryl group of 6 to 18 carbon atoms, an alkoxyl group of 1 to 22 carbon atoms or an aryloxy group of 6 to 18 carbon atoms, wherein $R^1$, $R^2$ and $R^3$ each may be the same or different.

$R^1$, $R^2$ and $R^3$ each represent an alkyl group, an aryl group, an alkoxyl group or an aryloxy group each having the above numbers of carbon atoms, however, the number of carbon atoms of alkyl group, alkoxy group is preferably 1-10 and more preferably 2 to 8, and the number of carbon atoms of aryl group and aryloxy group is preferably 6-10 and more preferably 6 to 8.

One of the preferable aspects of the compound represented by Formula (I) is that $Z_1$ and $Z_2$ each independently represent a group represented by Formula (IV). It is also preferable that $R^1$, $R^2$ and $R^3$ each represent a methyl group.

Further, the compound represented by Formula (I) may form a dimmer represented by Formula (II).

Formula (II)

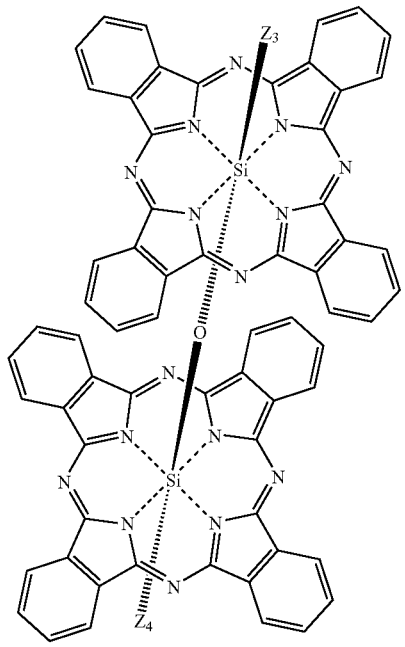

wherein $Z_1$ and $Z_2$ each independently represent a group represented by Formula (IV) a hydroxyl group, a chlorine atom, an aryloxy group of 6 to 18 carbon atoms, an alkoxyl group of 1 to 22 carbon atoms or a group represented by Formula (IV).

The toner of the present invention incorporates a phthalocyanine compound exhibiting an axial ligand which is referred to as a tetraazaporphin based compound represented by above Formula (I) in which silicon atom is employed as the center metal atom. "Axial ligand" refers to a ligand represented by Z in above Formula (I).

The toner incorporating the compound represented by Formula (I) develops superior color reproduction compared to a toner incorporating a phthalocyanine compound having no axial ligand. In particular, a toner employing the phthalocyanine compound represented by Formula (I) significantly exhibits the above tendency. It is assumed that the reason for the above superior color reproduction is that aggregation or crystallization of the compound represented by Formula (I) becomes more difficult to occur as its structure becomes more complicated compared to a phthalocyanine compound having no axial ligand. It is assumed that, as a result, the colorants are uniformly dispersed in a toner particle or in fixed images, whereby color reproduction is further enhanced.

Further, it is assumed that the phthalocyanine compound exhibits improved compatibility with binder resins in a toner or solubility in solvents or polymerizable monomers as its structure becomes more difficult to cause aggregation or crystallization. As a result, it is assumed that the phthalocyanine compound readily becomes uniformly dispersed during the toner producing process, whereby the phthalocyanine compound provides excellent color reproduction.

The $Z_1$ and $Z_2$ constituting compounds represented by Formula (I) is preferably a group represented by Formula (IV) among the groups described above. $R^1$, $R^2$, and $R^3$ existing in the groups represented by Formula (IV) are preferably an alkyl group, an aryl group, or an alkoxy group, all of which have 1 to 6 carbon atoms, and particularly preferably is an n-propyl group, an isopropyl group, an n-butyl group, an isobutyl group, or a t-butyl group. Further, $R^1$, $R^2$, and $R^3$ may be the same or different from each other.

In the present invention, above phthalocyanine compound may be employed singly or in combination of at least two of them. The content of the above phthalocyanine compound in a toner is preferably set to be in the range of 1 to 2% by mass to the total amount of the toner, more preferably in the range of 1 to 10% by mass, and further preferably 1 to 7% by mass. In particular, since the above compound is expected to exhibit a high molecular extinction, it is expected that the compound has a possibility to develop the effect of the present invention even though the amount thereof to be added is small.

Specific examples of a tetraazaporphin compound (a phthalocyanine compound having an axial ligand) represented by Formula (I) are shown in Table 1, but the compounds represented by Formula (I) which are usable for the toner of the present invention, are not limited to compounds shown in Table 1.

TABLE 1

| Compound No. | Z | $(Ra_1)na_1$, $(Ra_2)na_2$, $(Ra_3)na_3$ and $(Ra_4)na_4$ |
|---|---|---|
| I-1 | —O—$Si(CH_2CH_3)_3$ | |
| I-2 | —OH | |

TABLE 1-continued

| Compound No. | Z | $(Ra_1)na_1$, $(Ra_2)na_2$, $(Ra_3)na_3$ and $(Ra_4)na_4$ |
|---|---|---|
| I-3 | —O—$Si(CH_2CH_2CH_3)_3$ | |
| I-4 | —O—$Si(CH_3)_3$ | |
| I-5 | —O—$Si(CH(CH_3)_2)_3$ | |
| I-6 | —Cl | |
| I-7 | —O—$Si(CH_2CH_2CH_2CH_2CH_2CH_2CH_2CH_3)(CH_3)_2$ | |
| I-8 | —O—$Si(t\text{-}C_4H_9)_3$ | |
| I-9 | —O—$Si(CH_2CH_3)_3$ | —Cl |
| I-10 | —O—$Si(CH_2CH_3)_3$ | $(—Cl)_2$ |
| I-11 | —O—$Si(CH_2CH_3)_3$ | $—CF_3$ |
| I-12 | —O—$Si(C_{11}H_{23})(CH_3)_2$ | |
| I-13 | —O—$Si(C_{22}H_{45})(CH_2CH_3)(CH_3)$ | |
| I-14 | —O—$Si(CH_2CH_3)(CH_3)(C_6H_5)$ | |
| I-15 | —O—$Si(CH_2CH_3)(CH_3)(C_{18}H_{11})$ | |
| I-16 | —O—$Si(OCH_3)(OC_{22}H_{45})CH_3$ | |
| I-17 | —O—$Si(OC_2H_5)_2(OC_{10}H_{21})$ | |
| I-18 | —O—$CH_3$ | |
| I-19 | —O—$CH_2CH_3$ | |
| I-20 | —O—$CH_2(CH_2)_6CH_3$ | |
| I-21 | —O—$C_{11}H_{23}$ | |
| I-22 | —O—$C_{22}H_{25}$ | |
| I-23 | —O—$C_6H_5$(phenoxy group) | |
| I-24 | —O—$C_{10}H_7$(naphthoxy group) | |
| I-25 | —O—$C_{14}H_9$(anthryloxy group) | |
| I-26 | —O—$C_{16}H_9$(pyrenyloxy group) | |
| I-27 | —O—$C_{18}H_{11}$ | |

[Toner]

A toner incorporates at least a binder resin, a colorant, and a releasing agent, wherein the releasing agent contains a component of the first releasing agent containing an ester wax in an amount of 40 to 98% by mass, and preferably 60 to 95% by mass, and a component of the second releasing agent containing a branched hydrocarbon wax in an amount of 2 to 60% by mass, and preferably 5 to 40% by mass.

When the ratios of the component of the first releasing agent and the component of the second releasing agent in the releasing agent are within the above ranges, an adequate adhesion with a transferring material by the ester wax can be assured so that the fixing of sufficient strength can be achieved even at low temperature fixing, as well as the interaction effect of entanglement in molecular state between the branched hydrocarbon wax and the ester wax is sufficiently obtained, whereby transfer of the whole releasing agent to carriers can be suppressed.

Further, it is assumed that when ester groups are oriented on a skeleton featuring a central silicone atom group, hydrocarbon waxes further tend to orient around the skeleton, whereby distribution state and dispersibility of waxes in a toner are improved to result in suppression of occurrence of image unevenness.

The content ratio of the component of the first releasing agent to the component of the second releasing agent can be regarded as the ratio at the addition thereof. However, when the above ratio is determined from the toner, the ratio can be calculated from a ratio of the tertiary and quaternary carbon atoms derived from the branched hydrocarbon waxes (the percentage of the branch being described later) in the whole releasing agent and a previously determined ratio of only the branch contained in the branched hydrocarbon wax.

[Releasing Agent]

A toner constituting the developing agent of the present invention incorporates at least a binder resin, a colorant, and a releasing agent, wherein the releasing agent is composed of a component of the first releasing agent comprising an ester wax in an amount of 40 to 98% by mass, preferably 60 to 95% by mass, and a component of the second releasing agent comprising a branched hydrocarbon wax in an amount of 2 to 60% by mass, preferably 5 to 40% by mass.

When the ratios of the component of the first releasing agent and the component of the second releasing agent in the releasing agent are within the above ranges, the adhesion of the ester wax to an image bearing body (also referred to as a transferring material or an image supporting body) can be assured so that fixing of sufficient strength can be achieved even at low temperature fixing, as well as the interaction effect of entanglement in molecular state between the branched hydrocarbon wax and the ester wax is sufficiently obtained, whereby transfer of the whole releasing agent to the surface of toners can be suppressed.

[Ester Compound]

As the ester wax, being a component of the first releasing agent constituting the releasing agent of the toner of the present invention, any of a mono-ester compound, a di-ester compound, a tri-ester compound and a tetra-ester compound are usable. Examples of the above ester wax include esters represented by Formulae (1) to (3), shown below comprising a higher fatty acid and a higher alcohol, trimethylolpropane trimesters represented by Formula (4) below, glycerin trimesters represented by Formula (5) below, and pentaerythritol tetra-esters represented by Formula (6) below.

$$R^1—COO—R^2 \qquad \text{Formula (1)}$$

$$R_1—COO—(CH_2)_n—OCO—R_2 \qquad \text{Formula (2)}$$

$$R_1—OCO—(CH_2)_n—COO—R^2 \qquad \text{Formula (3)}$$

In above Formulae (1) to (3), each of $R^1$ and $R^2$ represents a hydrocarbon group of 13 to 30 carbon atoms, preferably of 17 to 22 carbon atoms, which may or may not have a substituent. $R^1$ and $R^2$ may be the same or different from each other.

Formula (4)

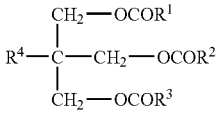

In above Formula (4), each of $R^1$ to $R^4$ represents a hydrocarbon group of 13 to 30, preferably 17 to 22 carbon atoms, which may or may not have a substituent. $R^1$ to $R^3$ may be the same or different from each other.

Formula (5)

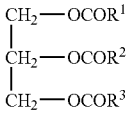

In above Formula (5), each of $R^1$ to $R^3$ represents a hydrocarbon group of 13 to 30, and preferably 17 to 22 carbon atoms, which may or may not have a substituent. $R^1$ to $R^3$ may be the same or different from each other.

Formula (6)

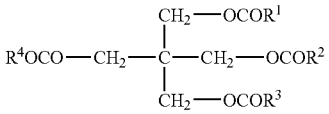

In above Formula (6), each of $R^1$ to $R^4$ represents a hydrocarbon group of 13 to 30, and preferably 17 to 22 carbon atoms, which may or may not have a substituent. $R^1$ to $R^4$ may be the same or different from each other.

As the specific examples of the mono-ester compounds represented by above Formula (1), the compounds represented by the following Formulae (1-1) to (1-8) can be exemplified.

Formula (1-1)

Formula (1-2)

Formula (1-3)

Formula (1-4)

Formula (1-5)

Formula (1-6)

Formula (1-7)

Formula (1-6)

As the specific examples of the di-ester compounds represented by above Formulae (2) and (3), the compounds represented by the following Formulae (2-1) to (2-7), and (3-1) to (3-3) can be exemplified.

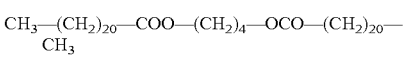
Formula (2-1)

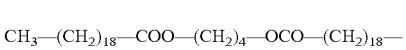
Formula (2-2)

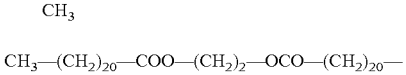
Formula (2-3)

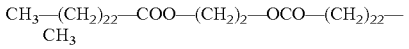
Formula (2-4)

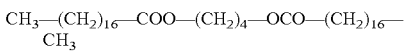
Formula (2-5)

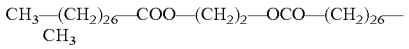
Formula (2-6)

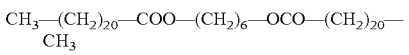
Formula (2-7)

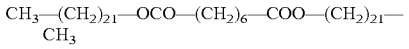
Formula (3-1)

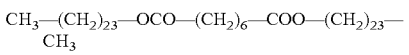
Formula (3-2)

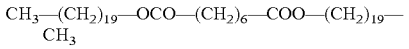
Formula (3-3)

As the specific examples of the tri-ester compounds represented by above Formula (4), the compounds represented by the following Formulae (4-1) to (4-6) can be exemplified.

Formula (4-1)

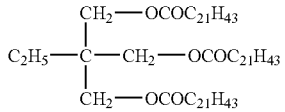

Formula (4-2)

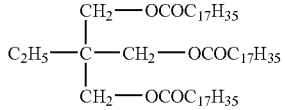

Formula (4-3)

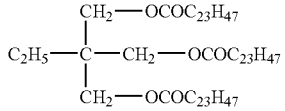

Formula (4-4)

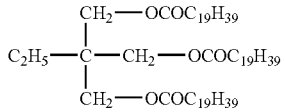

Formula (4-5)

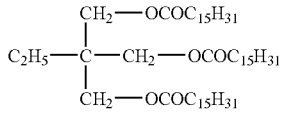

Formula (4-6)

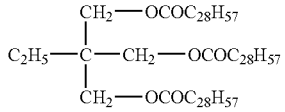

As the specific examples of the tri-ester compounds represented by above Formula (5) constituting a component of the first releasing agent, the compounds represented by the following Formulae (5-1) to (5-6) can be exemplified.

Formula (5-1)

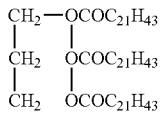

-continued

Formula (5-2)

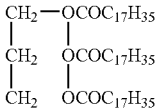

Formula (5-3)

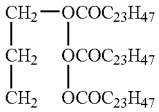

Formula (5-4)

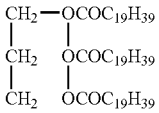

Formula (5-5)

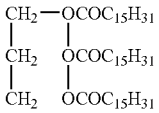

Formula (5-6)

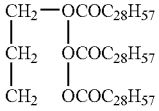

As the specific examples of the tetra-ester compounds represented by above Formula (6), the compounds represented by the following Formulae (6-1) to (6-5) can be exemplified.

Formula (6-1)

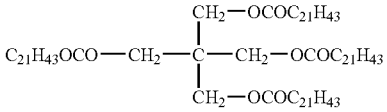

Formula (6-2)

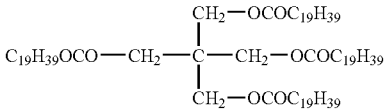

Formula (6-3)

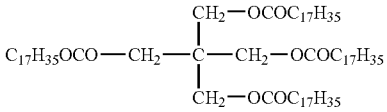

Formula (6-4)

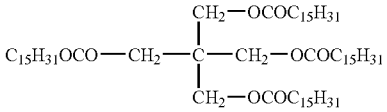

Formula (6-5)

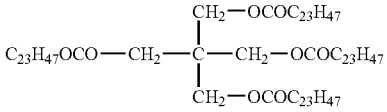

The ester wax constituting a component of the first releasing agent may be one having, in one molecule, a plurality of mono-ester structure, di-ester structure, tri-ester structure and tetra-ester structure.

As a component of the first releasing agent constituting the releasing agent, a combination of two or more kinds of the above ester compounds also can be employed.

[Branched Hydrocarbon Wax]

In the branched hydrocarbon wax, being a component of the second releasing agent of the releasing agent constituting the developing toner of the present invention, the ratio of branch is preferably from 0.1 to 20% and more preferably from 0.3 to 10%. The ratio of branch, namely the ratio of the sum of tertiary and quaternary carbon atoms in the total carbon atoms constituting the branched hydrocarbon wax, is a value obtained by the following method.

Since the ratio of the sum of tertiary and quaternary carbon atoms in the total carbon atoms constituting the branched hydrocarbon wax is in the range of from 0.1 to 20%, despite the aforesaid branched hydrocarbon wax exhibits a low melting point, the intermolecular entanglement due to the interaction effect between the branched hydrocarbon wax and the ester wax is assured, whereby occurrence of transfer of the releasing agent onto the surface of a toner particle tends to be suppressed.

The branch ratio of a branched hydrocarbon wax can be specifically determined according to Equation (i) below based on a spectrum obtained via 13C-NMR spectrometry under the conditions as described below.

$$\text{Branch ratio (\%)}=(C3+C4)/(C1+C2+C3+C4)\times 100 \qquad \text{Equation (i)}$$

In above Equation (i), C3 represents a peak area relating to tertiary carbon atoms, C4 represents a peak area relating to quaternary carbon atoms, C1 represents a peak area relating to primary carbon atoms, and C2 represents a peak area relating to secondary carbon atoms.

(Conditions of 13C-NMR Spectrometry)

Measuring apparatus: FT NMR Spectrometer Lambda 400 (manufactured by Nippon Denshi Co., Ltd.)
Measuring frequency: 100.5 MHz
Pulse condition: 4.0 μs
Data points: 32, 768
Delay time: 1.8 sec
Frequency range: 27,100 Hz
Cumulated number: 20,000
Measuring temperature: 80° C.
Solvent: benzene-$d^6$/o-dichlorobenzene-$d^4$=1/4 (v/v)
Sample concentration: 3% by mass
Sample tube: 5 mm ϕ
Measurement mode: 1H complete decoupling method Specific examples of the branched hydrocarbon wax include microcrystalline waxes such as HNP-0190, Hi-Mic-1045, Hi-Mic-1070, Hi-Mic-1080, Hi-Mic-1090, Hi-Mic-2045, Hi-Mic-2065, and Hi-Mic-2095 (all produced by Nippon Seiro Co., Ltd.), and also include waxes EMW-0001 and EMW-0003 containing an isoparaffin as the primary ingredient.

"Microcrystalline wax" means a wax, among petroleum waxes, having a higher percentage of branched hydrocarbon (isoparaffin) and/or cyclic hydrocarbon (cycloparaffin) in addition to straight chain hydrocarbon, differing from a paraffin wax whose primary ingredient is a straight chain hydrocarbon (normal paraffin). In general, since the microcrystalline wax incorporates low-crystalline isoparaffin and cycloparaffin in a large amount, the crystal size of the microcrystalline wax is small and the molecular weight thereof is large compared with a paraffin wax. Such microcrystalline wax exhibits 30 to 60 carbon atoms, a weight-average molecular weight of 500 to 800, and a melting point of 60 to 90° C.

As a microcrystalline wax constituting branched hydrocarbon wax, the one exhibiting a weight-average molecular weight of 600 to 800 and a melting point of 60 to 85° C. is preferred. Further, the microcrystalline wax exhibiting a low molecular weight, and, in particular, exhibiting a number average molecular weight of 300 to 1,000 is preferred, and is more preferably 400 to 800. Further, the ratio of the weight-average molecular weight to the number-average molecular weight (Mw/Mn) is preferably 1.01 to 1.20.

[Method for Producing the Branched Hydrocarbon Wax]

There are two methods for producing the above branched hydrocarbon wax; namely, a press-sweating method in which solidified hydrocarbon is separated, while maintaining raw oil at a specific temperature, and a solvent extraction method in which a solvent is added to raw oil of vacuum distillation residual oil or heavy distillates of petroleum to cause crystallization which is further subjected to filtration, of which the latter one, namely the solvent extraction method, is preferred. Further, since the above branched hydrocarbon wax, which can be obtained by the manufacturing methods described above, is colored, the above wax may be purified by using, for example, sulfuric acid-clay.

As a component of the second releasing agent, the above hydrocarbon compound having a branched chain structure or a cyclic structure may be used in combination of two or more thereof.

The amount of the whole releasing agent, to be added to the toner, is preferably 1 to 30% by mass, and more preferably 5 to 20% by mass relative to the amount of binding resins, which will be described later.

The melting point of the whole releasing agent constituting the toner is, for example, from 60 to 100° C., preferably from 60 to 100° C., and more preferably from 65 to 85° C.

The melting point of the releasing agent represents a temperature at the top of its endothermic peak of the releasing agent, which can be determined by using, for example, DSC-7 differential scanning calorimeter (produced by PerkinElmer, Inc.) or TAC7/DX thermal analyzer controller (produced by PerkinElmer, Inc.).

More specifically, 4.00 mg of a releasing agent is precisely weighed to two decimal places and enclosed in an aluminum pan (Kit No. 0219-0041), and then set onto a DSC-7 sample holder. Controlled temperature of a heat-cool-heat cycle is carried out under measuring conditions of a measurement temperature of 0 to 200° C., a rate of temperature increase of 10° C./min, and a rate of temperature decrease of 10° C./min, after which analysis was conducted based on the data of the 2nd heat. Measurement for reference was performed using an empty aluminum pan.

The melting point of only the ester wax or only the branched hydrocarbon wax is not particularly limited, as long as the melting point of the whole releasing agent is within the above range. However, the melting point of the ester wax alone is, for example, from 60 to 100° C., and preferably from 70 to 90° C., while the melting point of only the branched hydrocarbon wax is from 50 to 100° C., preferably from 60 to 100° C., and more preferably from 65 to 85° C.

[Other Additives]

The toner of the present invention may be one to which a charge control agent is further added. The charge control agent is not particularly limited, and as a negative charge control agent, a colorless, white or pale color charge control agent, exhibiting no harmful effect to color tone nor to transparency of the toner, is usable. For example, a metal complex of salicylic acid derivatives with zinc or chromium, a calixarene compound, an organic boron compound, and fluorine containing quanternary ammonium salt based compound are suitably employed. The above metal complex of salicylic acid described in patent documents such as JP-A 53-127726, and JP-A 62-145255 is usable. The above calixarene compound described in patent documents such as JP-A H2-201378 is usable. The above organic boron compound described in patent documents such as JP-A H12-221967 is usable. And the above fluorine containing quanternary ammonium salt based compound described in patent documents such as JP-A H3-1162 is usable. In case where such a charge control agent is employed, the amount employed is desirably from 0.1 to 10 parts by mass based on 100 parts by mass of a thermoplastic resin (a binding resin), and preferably from 0.5 to 5.0 parts by mass.

Further, an image stabilizer may be added to improve image preservation properties. Examples of the image stabilizer include compounds described in and cited on pages 10 to 13 of JP-A H8-29934, as well as commercially available compounds such as phenol based, amine based, sulfur based or phosphor based compounds. As a TV absorber, for example, an organic UV absorber or an inorganic UV absorber may be added for the same purpose as the above. Organic UV absorbers include benzotriazole based compounds such as 2-(2'-hydroxy-5'-t-butylphenyl)benzotriazole, and 2-(2'-hydroxy-3',5'-di-t-butylphenyl)benzotriazole; benzophenone based compounds such as 2-hydroxy-4-methoxy benzophenone, and 2-hydroxy-4-n-octyloxy benzophenone; and hydroxybenzoate based compounds such as phenyl salicylate, 4-t-butylphenyl salicylate, 2-5t-butyl-4-hydroxybenzoic acid-n-hexadecylester, and 2,4-di-t-butylphenyl-3',5'-di-t-butyl-4-hydroxybenzoate. The inorganic UV absorber includes titanium oxide, zinc oxide, cerium oxide, iron oxide, and barium oxide, of which the organic UV absorber is preferred. The UV absorber preferably exhibits a wavelength of 350 to 420 nm at a transmittance of 50%, and more preferably 360 to 400 nm. In case where the wavelength is shorter than 350 nm, UV interruption capability of the UV absorber is undesirably low, and in case where the wavelength is longer than 420 nm, the UV absorber is undesirably strongly colored. The amount to be added is not particularly limited, but is preferably in the range of from 10 to 200% by mass relative to the amount of dyes, and more preferably from 50 to 150% by mass.

In the toner of the present invention, in view of providing fluidity of toners or improving cleaning properties, an external additive may be employed by adding to and blending with the toner. The external additive is not particularly limited, and examples thereof include inorganic oxide particulates such as silica, alumina, and titania, as well as titanic acid compound particulates such as strontium titanate, barium titanate, and calcium titanate, all of which exhibit a number-average primary particle size of 5 to 300 nm. The external additive may be employed individually or in combination thereof. These internal additives are preferably employed after they have been subjected to a hydrophobicity treatment employing, for example, a silane coupling agent, a titanium coupling agent, a higher fatty acid, or silicone oil, in view of environment resistance stability and heat resistant storage properties. The amount of these external additives to be added is desirably 0.05 to 5 parts by mass based on 100 parts by mass of the toner, and preferably 0.1 to 3 parts by mass. Further, a lubricant such as aluminium stearate or zinc stearate may be employed.

[Characteristics of Toner of the Present Invention]

The toner of the present invention preferably exhibits the particle size of 3 μm or more and 8 μm or less with respect to the volume based median size (D50V).

By designing the toner size within the above range, it is more likely that a wider color reproduction range can be obtained when using the coloring materials of the present invention.

The volume-based median size of the toner of the present invention can be measured and calculated by employing a measuring apparatus in which "Coulter Multisizer TA-3" (manufactured by Beckman Coulter Inc.) is connected with a computer system for data processing (also manufactured by Beckman Coulter Inc.). Specifically, the aforesaid measurement is carried out as follows: 0.02 g of a toner is soaked in 20 ml of a surface active agent solution (which is employed for the purpose of dispersion of the toner and is prepared, for example, by diluting a neutral detergent containing a component of surface active agent by a factor of 10 in distilled water), and the resulting mixture is subjected to an ultrasonic dispersion for one minute to prepare a toner dispersion, which toner dispersion is then charged, using a pipette, into a beaker containing "ISOTON II" (produced by Beckman Coulter Inc.), placed on a sample stand, to achieve a displayed concentration of the measuring apparatus of 8%. By allowing the concentration to be in the above range, reproducible measured values can be provided. In the measuring apparatus, with the count of the measuring particle and the aperture size being set to 25,000 and 50 μm respectively, the measuring range of 1 to 30 μm was divided into 256 subdivisions, and then, a frequency count of each of the 256 subdivisions is calculated, whereby a particle size at the cumulative volume fraction of 50% from a larger value is designated as the volume-based median size.

The toner of the present invention preferably exhibits a coefficient of variation (CV value), with respect to the volume-based particle distribution, of 2% or more and 21% or less, and particularly preferably 5% or more and 15% or less.

The coefficient of variation with respect to the volume-based particle distribution represents a degree of dispersion in distribution of toner particles, and is calculated by Equation (1) below.

The smaller the CV value, the sharper the particle distribution, which means that the size of toner particles is more uniform.

$$\text{CV value (\%)} = \text{Standard Deviation}/\text{Median Size } (D50v) \times 100 \qquad \text{Equation (1)}$$

Since the toner particle size becomes more uniform by allowing the CV value to be in the above range, a variation of melting properties among toner particles can be suppressed during fixing in the presence of the metal compound of the present invention, a dye, and a quinacridone pigment, whereby formation of clear images can be performed.

With regard to the toner of the present invention, the softening point (Tsp) is preferably 70° C. or more and 130° C. or less, and particularly preferably 70° C. or more and 120° C. or less.

By regulating the softening point of the toner to be in the above range, adverse effects caused by heating during fixing can be reduced, and as a result, images can be formed without placing a heavy burden on a colorant, so that wider and more stable color reproduction of the formed visible images can be obtained.

Since low temperature fixing, in which the fixing temperature is far lower than typical, can be carried out without causing adverse effects, it is possible to carry out eco-friendly image formation in which reduction in power consumption has been achieved.

The softening point of the toner of the present invention can be regulated by, for example, the following methods: (1) a method to regulate the kinds and composition ratios of polymerizable monomers to obtain binding resins; (2) a method in which, in a toner fabricating process, for example, chain transfer agents are employed in a step for obtaining binding resins, and molecular weight of the resins is controlled by the kinds and the amounts of the chain transfer agents to be used; (3) a method to regulate the kinds and amounts of constituting materials such as a releasing agent to be used, or a method combining methods (1) to (3).

The softening point of the toner of the present invention can be determined using, for example, "FLOW TESTER CFT-500" (produced by Shimadzu Corp.) in such a manner that a column of 10 mm high is formed using a toner, and a pressure of 1.96×10 cPa is applied to the column employing a plunger while heating at a temperature increase rate of 6° C./minute so that the toner is allowed to be extruded from a of 1 mm diameter nozzle and 1 mm in length, whereby a softening fluid curve indicating a relationship between the amount of plunger descent and temperature is provided, and the temperature corresponding to a descent amount of 5 mm is designated as the softening point.

[Manufacturing Method of Toner]

Methods to manufacture the toner of the present invention are not specifically limited and listed may be a pulverization method, a suspension polymerization method, a mini-emulsion polymerization aggregation method, an emulsion polymerization aggregation method, a dissolution suspension method, and a polyester molecule elongation method, as well as other conventional methods. Of these, it is preferable to prepare the toner of the present invention via a mini-emulsion polymerization aggregation method. In a mini-emulsion polymerization aggregation method, a polymerizable monomer solution in which a release agent is dissolved is placed into an aqueous medium in which a surface active agent is dissolved with a concentration of not more than the critical micelle concentration, and by utilizing mechanical energy, a dispersion, in which 10-1,000 nm oil droplets are formed, is prepared. Water-soluble radical polymerization initiators are added to the resulting dispersion followed by polymerization, whereby binder resin particles are formed. Further, by associating (aggregating/fusing) binder resin particles, toner particles are obtained.

The reason why the mini-emulsion polymerization method is preferred is that since polymerization is carried out within each oil droplet, it is possible to form a state in which wax particles are assuredly included in the binder resins within the toner particle, and as a result, vaporization components are not generated until heated in a fixing apparatus.

In addition, in the mini-emulsion polymerization aggregation method, instead of the addition of the aforesaid water-soluble radical polymerization initiators, or together with the water-soluble radical polymerization initiators, it is also possible to achieve polymerization by adding oil-soluble radical polymerization initiators into the aforesaid monomer solution.

As the toner preparation method, according to the present invention, during formation of resin particles via the mini-emulsion polymerization aggregation method, it is possible to form resin particles having a structure of at least two layers composed of binder resins which differ in composition. In this case, polymerization initiators and polymerizable monomers are added to the first resin particle dispersion which is prepared via a conventional mini-emulsion polymerization process (being a first step polymerization), and the resulting system then undergoes polymerization (being the second step polymerization).

One example of a method for producing a toner of the present invention, the mini-emulsion polymerization aggregation method will now be specifically described. The method includes the following procedures.

(1) a dissolution and dispersion process in which a polymerizable monomer solution is prepared by dissolving or dispersing, toner particle constituting materials such as a release agent and a charge controlling agent according to need, in a polymerizable monomer used for a binding resin;

(2) a colorant dispersion process in which a colorant particle dispersion is prepared by dispersing such as a metal compound, a colorant and a release agent relating the present invention are dispersed in an aqueous medium;

(3) a polymerization process in which oil droplets of the aforesaid polymerizable monomer solution are formed in an aqueous medium and then a binder resin particle dispersion is prepared using a mini-emulsion method;

(4) an aggregation and fusion process in which aggregated particles are formed by salting out, aggregating and fusing binder particles and colorant particles in an aqueous medium;

(5) a ripening process in which a dispersion of the toner particles is prepared by ripening to adjust the shape of aggregated particles with thermal energy;

(6) a cooling process in which the dispersion of toner particles are cooled;

(7) a filtering and washing process in which the aforesaid toner particles are subjected to solid-liquid separation from the cooled toner particle dispersion, and a surfactant and the like are removed from the aforesaid colored particles;

(8) a drying process in which dries the washed toner particles are dried; and (9) an external additive treatment process in which an external additive is added to the dried toner particles.

Each of the above processes will now be described below.

(1) Dissolution-Dispersion Process

This process is a process to dissolve or disperse toner particle constituting materials such as a release agent and a colorant in a polymerizable monomer to prepare a polymerizable monomer solution.

The amount of the release agent is set so as to have the content of the release agent in the toner to be in the aforementioned range. An oil-soluble polymerization initiator and/or other oil-soluble components may be added to the polymerizable monomer solution.

(2) Colorant Dispersion Process

This colorant dispersion process is one in which the metal compound, the colorant and the release agent relating the present invention are dispersed in an aqueous medium to prepare a colorant particle dispersion. When other colorant is used, the colorant is separately prepared. When dispersion is carried out, a surfactant is used for the dispersion.

It is possible to prepare these colorant particle dispersions by dispersing colorants into an aqueous medium. The dispersion process of colorant particles is carried out in such a state that the concentration of a surfactant is not less than the critical micelle concentration (CMC) in water. Homogenizers employed for the dispersion process of colorant particles are not particularly limited and preferably employed are ultrasonic homogenizers, mechanical homogenizers, and pressure homogenizers such as a Manton-Gaulin homogenizer or pressure system homogenizer, as well as medium type homogenizers such as a sand grinder, a Getzmann mill, or a diamond fine mill.

It is possible to employ colorant particles which have undergone surface property modification. Specifically, colorant particles are dispersed into solvents and surface property modifying agents are then added to the above dispersion. Subsequently, by increasing the temperature of the above system, the targeted reaction is carried out. After completion of the reaction, the colorant particles are collected via filtration. After repeated washing with the same solvents, drying is carried out, whereby it is possible to prepare minute colorant particles which have been treated with the surface property modifying agents.

(3) Polymerization Process

As one of the preferable examples of the polymerization process, the aforesaid polymerizable monomer solution is added to an aqueous medium incorporating a surfactant at a concentration of not more than the critical micelle concentration, and oil droplets are formed via application of mechanical energy. Subsequently, by adding a water-soluble radical polymerization initiator, a polymerization reaction is carried out in the aforesaid oil droplet. Further, resin particles which are employed as nucleus particles may be added in the aqueous medium.

In this polymerization process, binder resin particles containing a release agent and a binder resin are obtained. The binder resin particles may be or may be not colored. Colored binder resin particles are formed by polymerizing a monomer composition incorporating colorants. Further, when binder resin particles, which are not colored, are used, a colorant particle dispersion is added into the binder resin particle dispersion during the aggregation process, which will be described below, followed by aggregation of the binder resin particles with the colorant particles, whereby toner particles are obtained.

"Aqueous medium", as described herein, refers to a medium which is composed of water as a major component (at least 50% by mass). Examples of a component other than water include: methanol, ethanol, isopropanol, butanol, acetone, methyl ethyl ketone, and tetrahydrofuran. Of these, specifically preferred are alcohol based organic solvents such as methanol, ethanol, isopropanol, and butanol, which do not dissolve the resins.

Further, methods to disperse a polymerizable monomer solution into an aqueous medium are not particularly limited, but a method is preferred in which dispersion is carried out via application of mechanical energy. Homogenizers in which oil droplet dispersion is carried out via application of mechanical energy are not particularly limited, but examples thereof include "CLEARMIX", ultrasonic homogenizers, mechanical homogenizers, Manton-Gaulin, and pressure system homogenizers. Further, the dispersed particle diameter of the polymerizable monomer solution is preferably 10-1,000 nm, but is more preferably 30-300 nm.

(4) Aggregation and Fusion Process

An aggregation and fusion process is one in which the binder resin particles, formed via the aforesaid polymerization process, are aggregated and fused in an aqueous medium. During the aggregation and fusion process, if the aforesaid binder resin particles are not colored, a colorant particle dispersion is added into the binder resin particle dispersion, followed by salting out, aggregation and fusion of the binder resin particles and the colorant particles. During the intermediate step of the above aggregation and fusion process, it is possible to carry out aggregation by the addition of binder resin particles which differ in the resin composition.

Further, in the aforesaid aggregation and fusion process, it is possible to carry out aggregation and fusion by the addition of internal additive particles such as charge control agents together with binder resin particles and colorant particles.

A preferred aggregation and fusion method is that aggregating agents composed of alkaline metal salts and alkaline earth metal salts are added, in an amount to reach at least the critical aggregation concentration, to an aqueous medium in which binder resin particles and colorant particles exist, whereby these particles are aggregated. Subsequently, heating is carried out to at least the glass transition temperature of the binder resin particles, as well as to at least the melt peak temperature of a release agent, whereby salting out, and aggregation and fusion are simultaneously carried out.

During this aggregation and fusion process, it is desired to quickly increase the temperature by heating, and the temperature increasing rate is preferably at least 1° C./minute. The upper limit of the temperature increasing rate is not particularly limited. However, since coarse particles are generated via the progress of quick aggregation and fusion, the heating rate is preferably at most 15° C./minute to retard the formation of coarse particles.

Further, it is critical that after the temperature of the binder resin particle and colorant particle dispersion reaches not less than the glass transition and also not less than the melt peak temperature of the release agent, salting out, coagulation and fusion are allowed to continue by maintaining the temperature of the aforesaid dispersion for a predetermined duration. As noted above, by maintaining the temperature of the dispersion for the predetermined duration, growth (coagulation of binder resin particles and colorant particles) of toner particles and fusion (elimination of the interface between the particles) are effectively carried out, whereby it is possible to enhance endurance of the finally prepared toner.

(5) Ripening Process

The ripening process is preferably carried out using thermal energy (by heating).

Specifically, the ripening process is one in which a system incorporating aggregated particles is stirred while heating, and the shape of aggregated particles is regulated by controlling the heating temperature, the stirring rate, and the heating temperature to obtain a desired average circularity, whereby toner particles having the targeted shape are prepared.

Further, during the ripening process, a binder resin particle dispersion is further added to the aforesaid toner particle dispersion so that the binder resin particles are adhered onto the surface of the toner particle to result in fusion and toner particles designated, as a so-called core-shell structure, may be formed. In this case, it is preferable that the glass transition temperature of the binder resin particles forming the shell is regulated to be 20° C. higher than that of the binder resin particles which constitute the core.

Further, when binder resin particles employed in the aforesaid aggregation and fusion process are composed of resins (hydrophilic resins) which are prepared by employing, as a raw material, polymerizable monomers having an ionic dissociation group, described below, and resins (hydrophobic resins) which are prepared by employing, as a raw material, only polymerizable monomers having no ionic dissociation group, it is possible to form toner particles having the core-shell structure in such a manner that during the above ripening process, the hydrophilic resins are oriented on the surface side of the aggregated particle, while hydrophobic resins are oriented on the interior side of the aggregated particle.

(6) Cooling Process

This process is a process of subjecting the dispersion of the toner particles to the cooling treatment. The condition of the cooling treatment is to cool is preferably at a cooling rate of 1-20° C./min. The method of the cooling treatment, although it is not specifically limited, may include a method of cooling by introducing a cooling medium from outside of a reaction container and a method of cooling by directly charging cool water into the reaction system.

(7) Filtering•Washing Process

The filtering•washing process contains: a filtering process in which toner particles are separated from the liquid phase of the dispersion of the toner particles having been cooled down to a predetermined temperature in the above process; and a washing process in which such as the surfactant, the salting-out agent or the alkaline agent used in the ripening process is removed from a toner cake (an aggregation substance with a cake-shape) having been filtered. In the washing treatment, the washing with water is repeated until the electric conductivity of the filtrated water is decreased as low as 10 μS/cm. In the filtering process, known methods such as the centrifugal separation method, vacuum filtration method using Nutsche, and the filter method using a filter press are employed. The filtering method is not specifically limited.

(8) Drying Process

This process is a process of subjecting the toner cake having been washed to the dry treatment to obtain dried colored particles. Listed as the dryer used in this process may be, for example, a spray dryer, a vacuum-freeze dryer, and a decompression dryer, and it may be used a stationary rack-dryer, a movable rack-dryer, a fluidized dryer, a rolling dryer, an agitation dryer and other dryers. The water content of the dried colored particle is preferably 5% by weight or less, more preferably 2% by weight or less. When the toner particles having been subjected to the dry process are agglomerated with a weak intermolecular force among the particles, the agglomerate may be subjected to a pulverizing treatment. Herein, mechanical type of pulverizers such as a jet-mill, HENSCHEL MIXER, a coffee mill, a food processor may be used as the pulverizing treatment machine.

(9) External Additive Treatment Process

This process is a process of manufacturing the toner by mixing an external additive with the dried toner particles according to the necessity. As the mixer for the external additive, mechanical type of mixers such as a HENSCHEL MIXER and a coffee mill may be used.

[Binder Resin]

When the toner particles which constitute the toner of the present invention are manufactured by, for example, a pulverizing method or a dissolution suspension method, varieties of known binder resins may be used, examples of which include: vinyl resins such as a styrene resin, a (meth) acrylate resin, a styrene-(meth)acrylate copolymer and an olefin resin; a polyester resin; a polyamide resin; a carbonate resin; polyether; a polyvinyl acetate resin; polysulfone; an epoxy resin; a polyurthane resin; and a urea-resin. These resins may be used alone or in combination of two or more resins.

When the toner particles which constitute the toner of the present invention are manufactured by, for example, a suspension polymerization method, a mini-emulsion polymerization aggregation method or an emulsion polymerization aggregation method, the following polymerizable monomers may be used to prepare a resin constituting the toner: styrene or styrene derivatives, for example, styrene, o-methylstyrene, m-methylstyrene, p-methylstyrene, α-methylstyrene, p-chlorostyrene, 3,4-dichlorostyrene, p-phenylstyrene, p-ethylstyrene, 2,4-dimethylstyrene, p-t-butylstyrene, p-n-hexylstyrene, p-n-octylstyrene, p-n-nonylstyrene, p-n-decylstyrene, and p-n-dodecylstyrene; methacrylic acid ester derivatives, for example, methyl methacrylate, ethyl methacrylate, n-butyl methacrylate, iso-propyl methacrylate, iso-butyl methacrylate, t-butyl methacrylate, n-octyl methacrylate, 2-ethylhexyl methacrylate, stearyl methacrylate, lauryl methacrylate, phenyl methacrylate, diethylaminoethyl methacrylate and dimethylaminoethyl methacrylate; acrylic acid ester derivatives, for example, methyl acrylate, ethyl acrylate, iso-propyl acrylate, n-butyl v, t-butyl acrylate, iso-butyl acrylate, n-octyl acrylate, 2-ethylhexyl acrylate, stearyl acrylate, lauryl acrylate and phenyl acrylate; olefins, for example, ethylene, propylene and isobutylene; halogenated vinyl polymers, for example, vinyl chloride, vinylidene chloride, vinyl bromide, vinyl fluoride and vinylidene fluoride; vinyl esters, for example, vinyl propionate, vinyl acetate and vinyl benzoate; vinyl ethers, for example, vinyl methyl ether and vinyl ethyl ether; vinyl ketones, for example, vinyl methyl ketone, vinyl ethyl ketone and vinyl hexyl ketone; N-vinyl compounds, for example, N-vinyl carbazole, N-vinyl indole and N-vinyl pyrrolidone; and derivatives of acrylic acid and methacrylic acid, for example, acrylonitrile, methacrylonitrile and acrylamide. These vinyl monomers may be used alone or in combination of two or more.

As a polymerizable monomer, one containing ionic-dissociative group is preferably used in combination. Polymerizable monomers containing an ionic-dissociative group include, for example, those having a side chain containing a functional group such as a carboxyl group, a sulfonic acid group or a phosphoric acid group, of which specific examples include such as acrylic acid, methacrylic acid, maleic acid, itaconic acid, cinnamic acid, fumaric acid, monoalkyl maleate, monoalkyl itaconate, styrenesulfonic acid, allylsulfosuccinic acid, 2-acrylamido-2-methylpropanesulfonic acid, acid phosphooxyethyl methacrylate and 3-chloro-2-acid phosphooxypropyl methacrylate.

Further, a cross-linked resin can be obtained using polyfunctional vinyls such as divinylbenzener ethylene glycol dimethacrylate, ethylene glycol diacrylate, diethylene glycol dimethacrylate, diethylene glycol diacrylate, triethylene glycol dimethacrylate, triethylene glycol diacrylate, neopentylglycol dimethacrylate and neopentylglycol diacrylate.

The surfactant used to obtain a binder resin when the toner particles which constitute the toner of the present invention are manufactured by, for example, a suspension polymerization method, a mini-emulsion polymerization aggregation method or an emulsion polymerization aggregation method, is not specifically limited, however, examples of such a surfactant include ionic surfactants such as: sulfates (for example, sodium dodecylbenzenesulfate and sodium arylalkylpolyethersulfonate), sulfuric ester salt (for example, sodium dodecyl sulfate, sodium tetradecyl sulfate, sodium pentadecyl sulfate and sodium octyl sulfate) carboxylates (for example, sodium oleate, sodium laurate, sodium caprate, sodium caprylate, sodium caproate, potassium stearate and calcium oleate). Nonionic surfactants are also usable. Examples thereof include polyethylene oxide, polypropylene oxide, a combination of polypropylene oxide and polyethylene oxide, an ester of polyethylene glycol and a higher fatty acid, alkylphenol polyethylene oxide, an ester of polyethylene oxide and a higher fatty acid, an ester of polypropylene oxide and a higher fatty acid and sorbitan ester. These surfactants are used as an emulsifying agent when the toner is produced via an emulsion polymerization method, however, these surfactants may also be used in other process or for other purpose.

[Polymerization Initiator]

In manufacturing the toner particles of the present invention by a suspension polymerization method, a mini-emulsion polymerization aggregation method or an emulsion polymerization aggregation method, binder resin can be obtained through polymerization by using a radical polymerization initiator.

Specifically, oil-soluble radical polymerization initiators are usable in suspension polymerization and examples of an oil-soluble polymerization initiator include azo- or diazo-type polymerization initiators, e.g., 2,2'-azobis-(2,4-dimethylvaleronitrile), 2,2'-azobisisabutylonitrile, 1,1'-azobis(cyclohexane-1-carbonitrile), 2,2'-azobis-4-methoxy-2,4-dimethylvaleronitrile, azobisisobutylonitrile; peroxide type polymerization initiators, e.g., benzoyl peroxide, methyl ethyl ketone peroxide, diisopropylperoxycarbonate, cumene hydroperoxide, t-butyl hyroperoxide, di-t-butyl peroxidedicumyl peroxide, 2,4-dichlorobenzoyl peroxide, lauroyl peroxide, 2,2-bis-(4,4-t-butylperoxycyclohexyl)-propane, tris-(t-butylperoxy)triazine; and polymeric initiators having a side-chain of peroxide.

Water-soluble radical polymerization initiators are usable in a mini-emulsion polymerization coagulation method or an emulsion polymerization coagulation method. Examples of a water-soluble polymerization initiator include persulfates such as potassium persulfate and ammonium persulfate; azobisaminodipropane acetic acid salt, azobiscyanovaleric acid and its salt, and hydrogen peroxide.

[Chain Transfer Agent]

In manufacturing the toner particles of the present invention by the suspension polymerization method, a mini-emulsion polymerization coagulation method or an emulsion polymerization coagulation method, generally used chain transfer agents are usable for the purpose of controlling the molecular weight of a binder resin.

Chain transfer agents are not specifically limited, but examples thereof include mercaptans such as n-octylmercaptan, n-decylmercaptane and tert-dodecylmercaptan; n-octyl-3-mercaptopropionic acid ester, terpinolene, carbon tetrabromide, carbon and α-methylstyrene dimmer.

[Colorant]

When the toner of the present invention is used for a full color developer, it can be used in combination with such as a yellow toner, a magenta toner and a black toner, other than the toner of the present invention. As colorants which provide colors other than the color of the colorant relating the present invention, commonly known inorganic or organic colorants are usable. Specific colorants will be shown below.

Examples of black colorants include carbon black such as Furnace Black, Channel Black, Acetylene Black, Thermal Black and Lamp Black and magnetic powder such as magnetite and ferrite.

Orange or yellow colorants include C.I. Pigment Orange 31, C.I. Pigment Orange43, C.I. Pigment Yellow 12, C.I. Pigment Yellow 13, C.I. Pigment Yellow 14, C.I. Pigment Yellow 15, C.I. Pigment Yellow 74, C.I. Pigment Yellow 93, C.I. Pigment Yellow 94, C.I. and Pigment Yellow 138.

Green or cyan colorants include C.I. Pigment Blue 15, C.I. Pigment Blue 15:2, C.I. Pigment Blue 15.3, C.I. Pigment Blue 15:4, C.I. Pigment Blue 16, C.I. Pigment Blue 60, C.I. Pigment Blue 62, C.I. Pigment Blue 66 and C.I. Pigment Green 7.

Magenta or red colorants include C.I. Pigment Red 2, C.I. Pigment Red 3, C.I. Pigment Red 5, C.I. Pigment Red 6, C.I. Pigment Red 7, C.I. Pigment Red 15, C.I. Pigment Red 16, C.I. Pigment Red 48, C.I. Pigment Red 53, C.I. Pigment Red 57, C.I. Pigment Red 122, C.I. Pigment Red 123, C.I. Pigment Red 139, C.I. Pigment Red 144, C.I. Pigment Red 149, C.I. Pigment Red 166, C.I. Pigment Red 177, C.I. Pigment Red 178, and C.I. Pigment Red 222.

The foregoing colorants may be used alone or in combination with two kinds or more.

The colorant content is preferably 1-30% by weight, and more preferably 2-20% by weight.

Surface-modified colorants are also usable. Commonly known surface modifiers are usable and preferred examples thereof include a silane coupling agent, a titanium coupling agent and an aluminum coupling agent.

[Aggregating Agent]

Aggregating agents usable in manufacturing the toner particles of the present invention by a mini-emulsion polymerization aggregation method or an emulsion polymerization aggregation method include, for example, alkali metal salts and alkaline earth metal salts. Alkali metals constituting an aggregating agent include, for example, lithium, sodium and potassium; alkaline earth metals constituting a coagulant include, for example, magnesium, calcium, strontium and barium. Of the foregoing, potassium, sodium, magnesium, calcium and barium are preferred. Counter-ions for the alkali metal or the alkaline earth metal (anion constituting a salt) include, for example, chloride ion, bromide ion, iodide ion, carbonate ion and sulfate ion.

[Average Circularity of Toner Particle]

The toner particles of the present invention preferably exhibit an average circularity of 0.920-1.000, and more preferably an average circularity of 0.930-0.980 in view of improvement of a transfer efficiency. The average circularity is represented by the following equation (3).

Average circularity={(circumference of a circle having an area equivalent to the projected area of a particle)/(a circumference of the projected particle)} Equation (3)

[External Additives]

To improve flowability or charging property or to enhance cleaning capability, so-called external additives may be added to the toner of the present invention. External additives are not specifically limited, and a variety of inorganic particles, organic particles and lubricants are usable as an external additive.

Inorganic oxide particles of silica, titania, alumina and the like are preferably used for inorganic particles. The inorganic particles may be surface-treated preferably by using, for example, a silane coupling agent and titanium coupling agent to enhance hydrophobicity, Spherical organic particles having an average primary particle diameter of 10-2000 nm are also usable. For example, polystyrene, poly(methyl methacrylate) and styrene-methyl methacrylate copolymer are usable as organic particles.

External additives are incorporated to the toner preferably in an amount of 0.1-5.0% by weight, and more preferably 0.5-4.0% by weight. External additives may be incorporated singly or in combination.

The toner of the invention can be used as a magnetic or non-magnetic single-component developer, however, it can also be used as a double-component developer by being mixed with a carrier.

As carriers usable in combination with the toner of the present invention, those conventionally known as a carrier for double-component developing are usable. Examples thereof include: a carrier composed of a magnetic particle such as iron and ferrite, a resin coated carrier prepared by coating the magnetic particle with a resin and a binder type carrier prepared by dispersing magnetic particles into a binder resin are usable. Among these carriers, a resin coat carrier using a silicone resin, a copolymer resin (graft resin) of organopolysiloxane and a vinyl monomer or a polyester resin is preferably used in view of toner spending and a carrier coated with a resin formed by reacting isocyanate to the copolymer resin of organopolysiloxane and a vinyl monomer is preferable in view of durability, environmental stability and anti-spending property. As the above vinyl monomer, a monomer having a substituent reactive with isocyanate, such as a hydroxyl group is preferably used. The carrier having a volume average diameter of from 20 to 100 μm and preferably from 20 to 60 μm is used for keeping high image quality and preventing fog.

When the toner of the present invention is used as a double-component developer, full-color images exhibiting an excellent quality can be obtained with a high printing rate while exhibiting no problem using a tandem type image forming apparatus. Further, by suitably selecting toner constituting materials, the toner of the present invention can be preferably utilized for an image forming method with so-called low temperature fixing in which the temperature of the paper is around 100° C. while fixing.

When the toner is used as a double-component developer, there may be utilized magnetic particles composed of materials conventionally known in the art including metals such as iron, ferrite, or magnetite and alloys of the above metals with such as aluminum or lead. Specifically, ferrite particles are preferable. The carrier having a volume average particle diameter of 15-100 μm is preferable, but a more preferable range is from 25-80 μm.

When used as a nonmagnetic single-component developer, the toner itself is charged with being rubbed or pressed onto a charging member or the developing roller surface. Image formation in a nonmagnetic single-component development system can simplify the structure of a developing device, leading to a merit of compactification of the whole image forming apparatus. Therefore, the use of the toner of the present invention as a single-component developer can achieve full-color printing in a compact printer, making it feasible to prepare full-color prints of superior color reproduction even in a space-limited working environment.

[Image Forming Apparatus for Image Forming Employing Toner of the Present Invention]

An Image forming method, which is carried out employing the toner according to the present invention, will now be described. The electrophotographic system image forming method, which is carried out employing the toner according to the present invention, includes at least the following processes: namely (1) an electrostatic latent image forming process which forms electrostatic latent images on an electrostatic latent image carrier (being a photoreceptor), (2) a development process which forms toner images by developing electrostatic latent images formed on the electrostatic latent image carrier by employing a developer which is prepared by incorporating the toner according to the present invention, (3) a transfer process which transfers toner images formed on the electrostatic latent image carrier onto a transfer body such as a sheet, and (4) a fixing process which fixes the toner images transferred onto the transfer body.

In addition to the aforesaid four processes, other processes may be included. For example, after transferring toner images, it is preferable to include a cleaning process which removes any residual toner on the surface of the electrostatic latent image carrier. Further, during the transfer process, the toner image transfer onto a recording medium, from the electrostatic latent image carrier, may be carried out via an intermediate transfer body.

The image forming method employing the toner of the present invention enables so-called low temperature fixing, whereby it is possible to prepare toner images of highly lustrous image quality. Further, it is possible to maintain excellent developability, transferability, fluidity, and storage properties over an extended period. Further, by realizing low temperature fixing, it is possible to further more reduce energy consumption during image formation.

FIG. 1 illustrates an example of an image forming apparatus in which the toner of the present invention is usable as a two-component developer.

In FIG. 1, 1Y, 1M, 1C and 1K each designate photoreceptors; 4Y, 4M, 4C and 4K each designate a developing means; 5Y, 5M, 5C and 5K each designate primary transfer rollers;

5A designates a secondary transfer roller; 6Y, 6M, 6C and 6K each designate cleaning means; the numeral 7 designates an intermediate transfer unit; the numeral 24 designates a thermal roll type fixing device; and the numeral 70 designates an intermediate transfer material.

This image forming apparatus is called a tandem color image forming apparatus, which is, as a main constitution, composed of plural image forming sections 10Y, 10M, 10C and 10K, an intermediate transfer material unit 7 including an endless belt form of a transfer belt, paper feeding and conveying means 22A to 22D to convey recording member P having thereon toner image 17 and heated roll-type fixing device 24. Original image reading device SC is disposed in the upper section of image forming apparatus body A.

Image forming section 10Y to form a yellow image contains a drum-form photoreceptor 1Y; electrostatic-charging means 2Y, exposure means 3Y and developing means 4Y which are disposed around the photoreceptor 1Y; primary transfer roller 5Y; and cleaning means 6Y.

Image forming section 10M to form a magenta image as another color contains a drum-form photoreceptor 1M; electrostatic-charging means 2M, exposure means 3M and developing means 4M which are disposed around the photoreceptor 1M; primary transfer roller 5M; and cleaning means 6M.

Image forming section 10C to form a cyan image as another color contains a drum-form photoreceptor 1C; electrostatic-charging means 2Y, exposure means 3C and developing means 4C which are disposed around the photoreceptor 1C; primary transfer roller 5C; and cleaning means 6C.

Further, there are provided an image forming section 10K to form a black image containing a drum-form photoreceptor 1K; electrostatic-charging means 2K, exposure means 3K and developing means 4K which are disposed around the photoreceptor 1K; primary transfer roller 5K; and cleaning means 6K.

Intermediate transfer unit 7 of an endless belt form is turned by plural rollers has intermediate transfer material 70 as the second image carrier of an endless belt form, while being pivotably supported.

The individual color images formed in image forming sections 10Y, 10M, 10C and 10K are successively transferred onto the moving intermediate transfer material (70) of an endless belt form by primary transfer rollers 5Y, 5M, 5C and 5K, respectively, to form a composite color image. Recording member P of paper or the like, as a final transfer material housed in paper feed cassette 20, is fed by paper feed and conveyance means 21 and conveyed to secondary transfer roller 5A through plural intermediate rollers 22A, 22B, 22C and 22D and resist roller 23, and color images are transferred together on recording member P. The color image-transferred recording member (P) is fixed by heat-roll type fixing device 24, nipped by paper discharge roller 25 and put onto paper discharge tray 26 outside a machine.

After a color image is transferred onto recording member P by secondary transfer roller 5A, intermediate transfer material 70 which separated recording member P removes any residual toner by cleaning means 6A.

The primary transfer roller 5K is always compressed to the photoreceptor 1K. Other primary rollers 5Y, 5M and 5C are each the photoreceptors 1Y, 1M and 1C, respectively, only when forming color images.

Secondary transfer roller 5A is compressed onto intermediate transfer material 70 only when recording member P passes through to perform secondary transfer.

In the process of image formation, toner images are formed on photoreceptors 1Y, 1M, 1C and 1K, through electrostatic-charging, exposure and development, toner images of the individual colors are superimposed on the endless belt form, intermediate transfer material 70, transferred together onto recording member P and fixed by compression and heating in heat-roll type fixing device 24. After completion of transferring a toner image to recording member P, intermediate transfer material 70 cleans any toner remained on the intermediate transfer material by cleaning device 6A and then goes into the foregoing cycle of electrostatic-charging, exposure and development to perform the subsequent image formation.

Housing 8, which can be pulled out from the apparatus body A through supporting rails 82L and 82R, houses image forming sections 10Y, 10M, 10C and 10K and intermediate transfer unit 7 of an endless belt form. Intermediate transfer unit 7 contains an intermediate transfer material of an endless belt form which can be turned via rollers 71, 72, 73, 74, 76 and 77.

Moreover, a full-color image formation method using a non-magnetic single-component developer can be realized by using, for example, an image forming apparatus in which the afore-mentioned development means for a double-component developer is substituted with a well-known development means for a non-magnetic single-component developer.

Further, the fixing method that can be used for an image formation method using the toner of the present invention is not particularly limited, and a well-known fixing system can be applied. Examples of a well-known fixing system are: a roller fixing system containing a heat roller and a pressure roller; a fixing system containing a heat roller and a pressure belt: a fixing system containing a heat belt and a pressure roller; a belt fixing system composed of the heat belt and a press belt. Any of these systems may be used. Moreover, as a heating system, well-known heating systems can be used such as a halogen lamp system, and IH fixing system.

Figure 2:
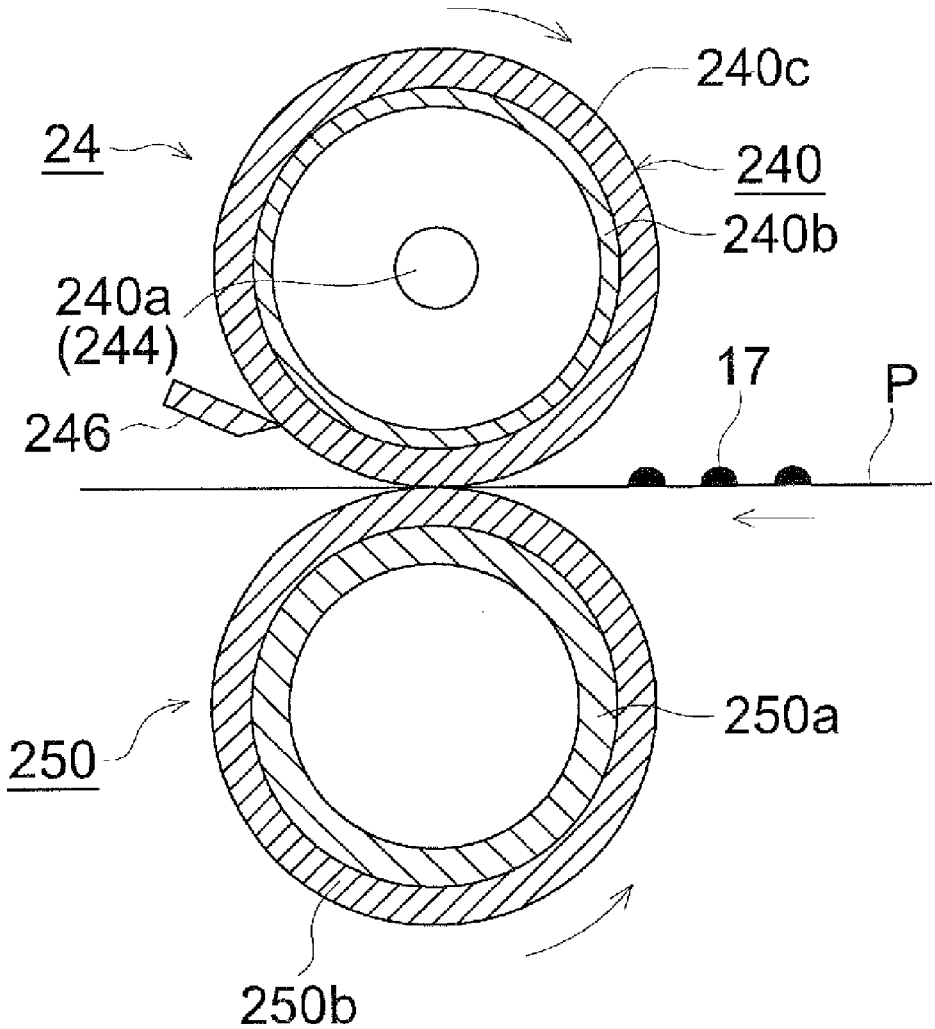
FIG. 2 is a schematic view showing an example of a fixing device employing heat rollers

As specific examples of a fixing device: a fixing device using a heat roller; and a fixing device using a heat roller and a pressure belt, will be described. FIG. 2 is a schematic view showing an example of a fixing apparatus using a heat roller.

The fixing device 24 shown in FIG. 2 contains a heat roller 240 and a pressure roller 250 abutting the heat roller 240. In FIG. 2, reference numeral 246 denotes a separation nail and P is a paper on which a toner image 17 is formed (transfer sheet).

The heat roller 240 contains a coating layer 240*b* made of a fluorocarbon resin or an elastic body formed on a surface of a cored bar 240*a*. The heat roller 240 further contains a heat member 244 made of a linear heater. Numeral 240*c* denotes a release layer (a heat resistant [0 1 8 1 resin layer).

The cored bar 240*a* is composed of a metal and the inner diameter thereof is preferably 10-70 mm. The metal composing the cored bar 240*a* is not specifically limited, and such metals may be listed including, for example, iron, aluminum, copper or alloys of these metals.

The wall thickness of the cored bar 240*a* is preferably 0.1-15 mm, which is determined considering the balance between the requirement of energy saving (making the wall thinner) and the strength (depending on the component materials). For example, in order to keep the strength equivalent to that of the cored bar made of 0.57 mm thickness iron by the cored bar made of aluminum, the thickness of 0.8 mm is required.

As the fluorocarbon resin composing a surface of the coating layer 240*c*, for example, PTFE (polytetrafluoroethylene) and PFA (tetrafluoroetylene-perfluoroalkylvinylether copolymer) may be listed.

The thickness of the coating layer 240*c* made of fluorocarbon resin is preferably 10-500 μm, and more preferably 20-400 μm.

When the thickness of the coating layer 240*c* containing fluorocarbon resin is less than 10 μm, the function as the coating layer cannot be adequately performed, so that the durability as the fixing device cannot be assured. On the other hand, the surface of the coating layer over 500 μm tends to have bruises due to paper powders, and the toner or other materials adheres at the bruise portions, causing the problem of image staining.

Further, as the elastic body composing the coating layer 240*c*, a silicon rubber and a silicon sponge rubber having high heat resistance, for example, LTV, RTV and HTV are preferably used.

An Asker C hardness of the elastic body composing the coating layer 240*c* is preferably less than 80°, and more preferably less than 60°.

Further, the thickness of the coating layer 240*c* made of the elastic body is preferably 0.1-30 mm, and more preferably 0.1-20 mm.

As the heat member 244, a halogen heater is preferably used.

The pressure roller 250 contains a coating layer 250*b* made of an elastic body formed on a surface of a cored bar 250*a*. The elastic body composing the coating layer 250*b* is not specifically limited, and various types of soft rubbers and sponge rubbers, for example, polyurethane rubber and silicon rubber are usable. Silicon rubber or silicon sponge rubber are preferably used as a material used for the coating layer 250*b*.

Further, the thickness of the coating layer 250*b* is preferably 0.1-30 mm, and more preferably 0.1-20 mm.

Further, the fixing temperature (the surface temperature of the heat roller 240) is preferably 70-180° C., and the fixing linear velocity is preferably 80-640 mm/sec. The nip width between the heat roller 240 and pressure roller 250 is preferably 8-40 mm, and more preferably 11-30 mm.

Separation nail 246 is provided in order to prevent the transfer paper subjected to thermal fixing treatment with heat roller 240 from winding on heat roller 240. Numeral 246*a* denotes a peeling baffle and 246*b* denotes a holder thereof.

Moreover, when the toner of the present invention is employed, it is desirable to use the fixing device which can supply efficiently the heat supplied from a heating member to a paper. It is desirable to specifically use the fixing device containing so called belt fixing method in which a heat-resistant belt is used for either a heating member or a pressure providing member.

Figure 3:
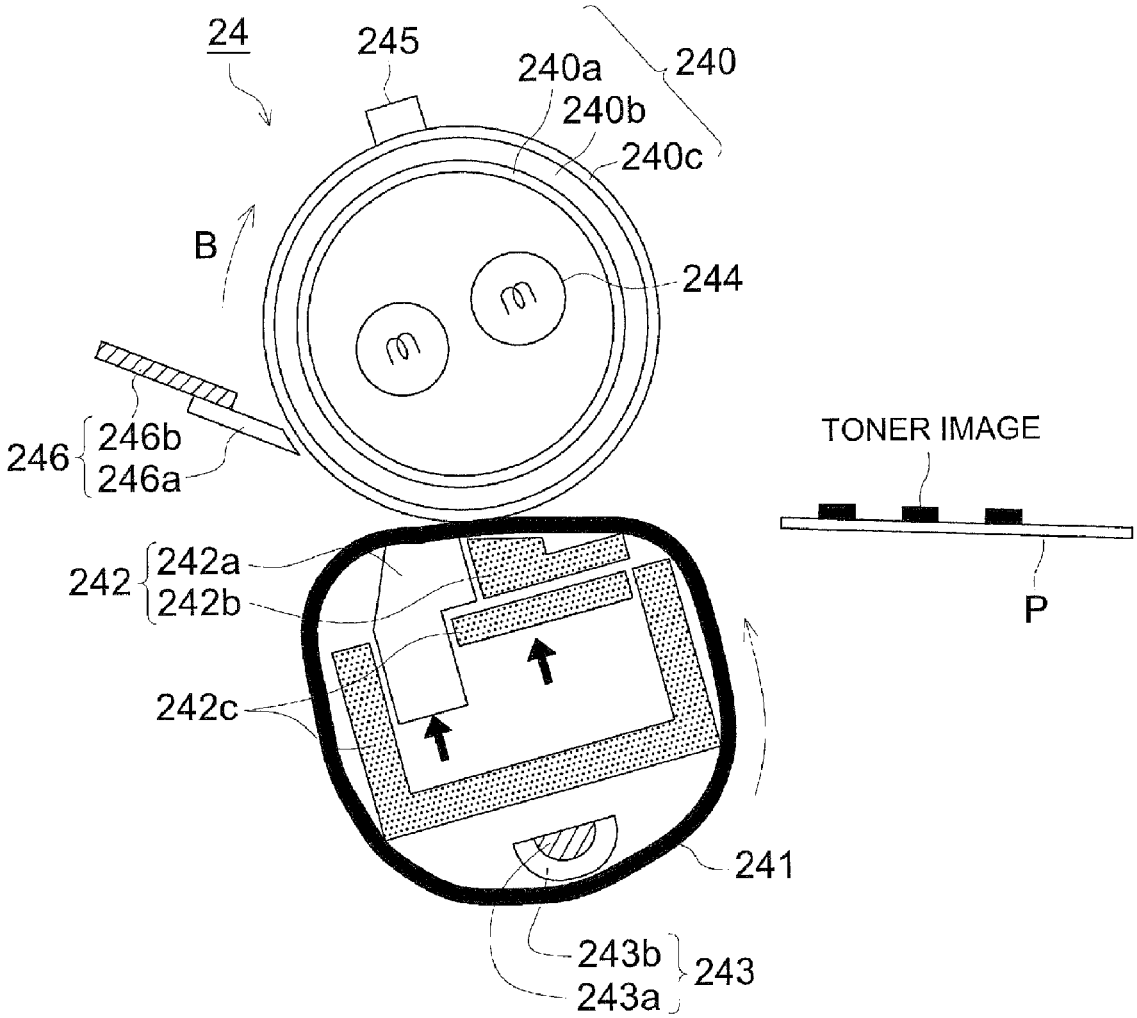
FIG. 3 is a schematic view showing an example of a fixing device of a belt fixing system

FIG. 3 is a schematic view showing an example of the fixing device (a type using a belt and a heat roller).

The fixing device 24 shown in FIG. 3 is a type using a belt and the heat roller for keeping the nip width, wherein the key section contains a heat roller 240 and a seamless belt 241, a pressure pads (pressure members) 242*a*, 242*b* which are pressed against the heat roller 240 via the seamless belt 241, and a lubricant supplying member 243. The lubricant supplying member 243 contains a lubricant holding member 243*a* and a lubricant supply amount controlling membrane 243*b*. B represents the rotation direction of the heat roller 240.

The heat roller 240 contains a heat resistant elastic body layer 240*b* and a releasing layer (heat resistant resin layer) 240*c* which are formed around a metal core (cylindrical cored bar) 240*a*, wherein inside the core 240*a* is provided with the halogen lamp 244 as the heat source. The temperature of a surface of the heat roller 240 is measured with the temperature sensor 245, and the halogen lamp is feedback-controlled by a temperature controller not shown in response to the measured signal, whereby the surface of the heat roller 240 is controlled so that the temperature thereof is constant. The seamless belt 241 is contacted as to be wound by a predetermined angle relative to the heat roller 240 to form a nip section.

Inside the seamless belt 241 is provided with a pressure pad 242 having a low friction layer on a surface thereof in the state of being pressed against the heat roller 240 via the seamless belt 241. The pressure pad 242 contains the pressure pad 242*a* to which a strong nip pressure is applied and the pressure pad 242*b* to which a weak nip pressure is applied, the pressure pads 242*a*, 242*b* being held by a holder 242*c* made of metal or other materials.

The holder 242*c* is further mounted with a belt-travel guide so that the seamless belt 241 can slide and rotate smoothly. Because the belt-travel guide chafes against an inner surface of the seamless belt 241, a member for the belt-travel guide is desired to have a lower friction coefficient and also has a low heat conduction in order not to take the heat away from the seamless belt 241. As a specific example of the material of the seamless belt 241, polyimide is preferably used.

EXAMPLES

Specific embodiments of the present invention will be explained below, however, the present invention is not limited thereto.

(Production Example of Cyan Toner 1: Production of Toner by Pulverization Method)

<Process A>

One hundred mass parts of polyester resin (condensation product, at a weight average molecular weight of 20,000, of bisphenol A ethylene oxide addition product with terephthalic acid and trimellitic acid), 1 mass part of branched hydrocarbon wax (Microcrystalline wax: HNP-0190, produced by Nippon Seiro Co., Ltd.), 6 mass parts of ester wax (1-6), 1 mass part of charge control agent containing dibenzilic acid boron were charge in a Henschel mixer (produced by Mitsui Miike Mining Co., Ltd.), and underwent a blending treatment at a peripheral rate of the stirring blade of 25 m/second over 5 minutes. During the above operation, the blending treatment was carried out by feeding chilled water at 9° C. into the jacket of the Henschel mixer, and the treatment was carried out while the temperature of the mixture was maintained at 25° C.

<Process B>

Subsequently, 5.5 parts by mass of a compound represented by silicon phthalocyanine (1-1) were charged in the above "Henschel mixer", and underwent a blending treatment at a peripheral rate of the stirring blade of 40 m/second over 30 minutes. During the above operation, a blending treatment was carried out while heated water at 40° C. was fed into the jacket of the Henschel mixer, and the treatment was carried out while the temperature of the mixture was maintained at 47° C.

<Process C>

The resulting mixture underwent a kneading treatment employing a biaxial extrusion kneader while heated at 140° C. The temperature of the kneaded product was 145° C. at the discharge section of the aforesaid kneader. After the kneading treatment, the resulting kneaded product was allowed to stand to cool for 6 hours.

<Pulverization and Classification Process>

When the temperature of the kneaded product reached 28° C., it was coarsely pulverized via a hammer mill, followed by pulverization via a "TURBOMILL PULVERIZER (produced by Turbo Kogyo Co., Ltd.)". Further, fine powder classification treatment was carried out employing an air flow classifier utilizing the Coanda effect, whereby toner particles of a volume median diameter of 5.4 μm were produced.

<External Additive Treatment Process>

The external additives described below were added with 0.6 mass part of silica treated with hexamethylsilazane (average primary particle diameter of 12 nm) and 0.8 mass part of titanium dioxide treated with n-octylsilane (average primary particle diameter of 24 nm), followed by being blended under conditions of a stirring blade peripheral rate of 35 m/second, a processing temperature of 35° C., and a processing period of 15 minutes, employing a Henschel mixer (produced by Mitsui Miike Mining Co., Ltd.). Based on the above steps a cyan toner (hereafter referred to as "Toner (1)") was obtained.

It was noted that the shape and particle diameter of the above toner particles resulted in no change by the addition of external additives.

(Production Example of Comparable Cyan Toner: Production of Toner by Pulverization Method)

Toner particles were obtained in the same manner as for Production example of cyan toner 1 except that 7.0 mass parts of ester wax (1-6) were used instead of 1 mass part of branched hydrocarbon wax (Microcrystalline wax) and 6 mass part of ester wax (1-6). The obtained toner particles were added with an external additive to obtain a cyan toner (hereafter referred to as Comparative cyan toner (H1)).

Comparative cyan toner (H2) was obtained in the same manner as for Production example of cyan toner 1 except that changes as shown in Tables 2-4 were made.

(Production Example of Cyan Toner 2: Toner Production Via Emulsion Polymerization-Association Method)

(1) Preparation example 1: Dispersion of silicon phthalocyanine represented by Formula (1)

While stirring, 7.0 mass parts of sodium n-dodecyl sulfate was dissolved in 160 mass parts of ion-exchanged water, whereby an aqueous surfactant solution was prepared. Subsequently, 20.0 mass parts of Compound (1-17) was gradually added to the resulting aqueous surfactant solution, followed by dispersion employing CLEARMIX W MOTION CLM-0.8 (produced by M Technique Co.), whereby a colorant particle dispersion (hereafter referred to as "Silicon phthalocyanine (Formula (I)) dispersion (1)" was prepared.

The volume median diameter of the colorant particles of Colorant particle dispersion (1) was measured to be 252 nm.

The volume median diameter of dye particles was calculated under the following conditions, employing "MICROTRAC UPA-150 (produced by Honeywell Co.).

Determination conditions included:

Sample refractive index: 1.59

Sample specific gravity: 1.05 (in terms of spherical particle)

Solvent refractive index: 1.33

Solvent viscosity: 0.797 (at 30° C.) and 1.002 (at 20° C.)

Zero point adjustment: adjustment was carried out by placing ion-exchanged water in a measurement cell.

(2) Preparation of Toner Particle 1

A. Preparation of Resin Particle for Core (a) First Step Polymerization

In a reaction vessel fitted with a stirrer, a temperature sensor, a cooling pipe and a nitrogen introducing unit, an aqueous surfactant solution prepared by dissolving 4 mass parts of an anionic surfactant of sodium dodecylsulfate ($C_{10}H_{21}(OCH_2CH_2)_2SO_3Na$) in 3,040 mass parts of ion-exchanged water was charged and a polymerization initiator solution prepared by dissolving 10 mass parts of potassium persulfate (KPS) in 40 mass parts of ion-exchanged water was added. After increasing the liquid temperature to 75° C., a polymerizable monomer solution containing 532 mass parts of styrene, 200 mass parts of n-butyl acrylate, 68 mass parts of methacrylic acid and 16.4 mass parts of n-octylmercaptan was dripped for over one hour and then the liquid was heated at 75° C. for two hours while stirring to carry our polymerization reaction (first step polymerization), whereby "Resin particle dispersion (1H)" incorporating "Resin particles (1H)" was prepared.

The weight average molecular weight of obtained Resin particles (1H) was 16500.

(b) Second Step Polymerization

In a flask fitted with a stirrer, a polymerizable monomer solution containing 101.1 mass parts of Styrene, 62.2 mass parts of n-butyl acrylate, 12.3 mass parts of methacrylic acid and 1.75 mass parts of n-octylmercaptan was charged, and then 10.0 mass parts of branched hydrocarbon wax (Microcrystalline wax: HNP-0190, produced by Nippon Seiro Co., Ltd.) and 83.0 mass parts of ester wax (1-2) were added. The internal temperature was raised to 90° C. to dissolve the materials, whereby a polymerizable monomer solution was prepared.

Separately, an aqueous surfactant solution was prepared by dissolving 3 mass parts of the anionic surfactant employed in the aforesaid first step polymerization in 1,560 mass parts of ion-exchanged water, and was heated so that the internal temperature reached 98° C. Subsequently, added to the above surfactant solution were 32.8 mass parts (in terms of solids) of the aforesaid "Resin Particles (1H)" and further, the above-mentioned polymerizable monomer solution incorporating the aforementioned waxes. Thereafter, by employing a mechanical homogenizer "CLEARMIX, produced by M Technique Co., a mixing and dispersing treatment was carried out over 8 hours, whereby an emulsion particle dispersion incorporating emulsion particles (oil droplets) at a dispersed particle diameter of 340 nm was prepared.

Subsequently, to the aforesaid oil droplet dispersion, added was a polymerization initiator solution prepared by dissolving 6 mass parts of potassium persulfate to 200 mass parts of ion-exchanged water. The resulting mixture was heated at 98° C. for 12 hours while stirred, whereby a polymerization reaction (a second step polymerization) was carried out. Via the aforesaid polymerization reaction, "Resin particle dispersion (1HM)" incorporating "Resin pericles (1HM)" was prepared.

The weight average molecular weight of formed "Resin Particles (1HM)" was 23,000.

(c) Third Step Polymerization

A polymerization initiator solution prepared by dissolving 5.45 mass parts of potassium persulfate in 220 mass parts of ion-exchanged water was added to "Resin particle dispersion (1HM)" formed via the aforesaid second step polymerization, and a polymerizable monomer solution containing 293.8 mass parts of Styrene, 154.1 mass parts of n-butyl acrylate and 7.08 mass parts of n-octylmercaptan was dripped over one hour under the temperature condition of 80° C.

After dripping the aforesaid polymerizable monomer solution, a polymerization reaction (a third step polymerization) was carried out by heating at 80° C. and stirring over two hours. Thereafter, the temperature was lowered to 28° C., whereby a resin particle dispersion incorporating Resin particles for core (1)

The weight average molecular weight of formed "Resin particles (1HM)" was 26,800.

(C) Preparation of Toner Particle (a) Formation of Core

<Process A>

Into a reaction vessel fitted with a stirrer, a temperature sensor, a cooling pipe, and a nitrogen introducing unit, 420.7 mass parts of Resin particles for core (1), 500 mass parts of ion-exchanged water and 60.5 mass parts of Silicon phthalocyanine (Formula (I)) dispersion (1) were charged and after regulating the interior temperature to 30° C. while stirring, the pH was regulated to 10 by the addition of a 5 mol/liter aqueous potassium hydroxide solution.

<Process B>

Subsequently, an aqueous solution, prepared by dissolving 2 mass parts of magnesium chloride hexahydrate in 1,000 mass parts of water, was added at 30° C. over 10 minutes, while stirring. After the addition, the resulting mixture was allowed to stand for three minutes, followed by further heating. The temperature of the above system was increased to 75° C. over 60 minutes.

Subsequently, the average diameter of associated particles was determined via "COULTER MULTISIZER 3 (produced by Beckmann Coulter Co.), and when the volume median diameter reached 6.5 μm, an aqueous solution prepared by dissolving 8.2 mass parts of sodium chloride in 50 mass parts of ion-exchanged water was added to terminate the particle growth.

<Process C>

Further, the liquid temperature was regulated to 80° C., and association was allowed to continue via heating and stirring over 4 hours, whereby a toner particle dispersion was obtained.

The average circularity of toner particles of the obtained toner particle dispersion was determined to be 0.940 employing "FPIA2100 (produced by Sysmex Corp.).

The liquid temperature was lowered to 30° C. at a rate of 8° C./minute. The average circularity of toner particles was determined to be 0.968 employing "FPIA2100 (produced by Sysmex Corp.).

<Washing and Drying Process>

Subsequently, prepared particles were filtered and washed several times with ion-exchanged water at 45° C. After the washing process, drying was carried out via an air flow of 40° C. to obtain toner particles having a volume median diameter of 6.4 μm.

<External Addition Process>

The obtained toner particles were added with an external additive containing 0.6 mass part of silica particles treated with hexamethylsilazane (at an average primary particle diameter of 12 nm) and 0.8 mass part of titanium dioxide treated with n-octylsilane (at an average primary particle diameter of 24 nm) and were subjected to an external addition treatment employing a Henschel mixer (produced by Mitsui Miike Mining Co., Ltd.), in such a manner that mixing was performed under conditions of a stirring blade peripheral rate of 35 m/second, a processing temperature of 35° C., and a processing period of 15 minutes. Thus, a cyan toner (hereafter referred to as Cyan toner (2)) was obtained.

No change was observed in the shape and the diameter of the toner particles after the addition of the external additive.

(Production Examples of Cyan Toners 3-18: Toner Production Via Emulsion Polymerization-Association Method)

Each of Cyan toners (3)-(18) was prepared in the same manner as in Production example of cyan toner 2, followed by conducting an external addition treatment, except that the colorant and the release agent were changed as shown in Tables 2-3. "Ratio (% by mass)" of silicon phthalocyanine in Table 2 represents the ratio of the mass of silicon phthalocyanine in the toner based on the total mass of the toner before the external additive treatment. "Amount (mass part)" of "Branched hydrocarbon wax" or "Ester wax" in Table 3 represents the ratio of the mass of "Branched hydrocarbon wax" or "Ester wax" based on the total mass of the "Branched hydrocarbon wax" and "Ester wax". "Ratio of total wax (% by mass)" wax in Table 3 represents the ratio of total mass of the "Branched hydrocarbon wax" and the "Ester wax" based on the total mass of the toner before the external additive treatment.

(Production Examples of Comparable Cyan Toner 3 and 4)

Each of Comparative cyan toners (H3)-(H6) was prepared in the same manner as in Production example of cyan toner 2, followed by conducting an external addition treatment, except that the colorant and the release agent were changed as shown in Tables 2-3.

(Preparation Examples of Developers 1-18 and Preparation Examples of Comparative Developers 16)

To each of the Cyan toners (1)-(18) and Comparative cyan toners (H1)-(H6) a ferrite carrier coated with a silicone resin and having a volume average particle diameter of 60 μm was mixed so that the content of each toner is 6% by mass, whereby Developers (1)-(18) and Comparative developers (H1)-(H 6) were obtained.

TABLE 2

| Cyan toner No. | Production Method | Silicon phthalocyanine Compound No. | Amount (mass part) | Amount (% by mass) | Dispersed Diameter (nm) |
|---|---|---|---|---|---|
| (1) | *1 | I-1 | 5.5 | 4.8 | 5.5 |
| (2) | *2 | I-17 | 20.0 | 5.6 | 6.5 |
| (3) | *2 | I-3 | 21.0 | 5.9 | 5.4 |
| (4) | *2 | I-15 | 22.0 | 6.1 | 6.5 |
| (5) | *2 | I-4 | 18.0 | 5.1 | 7.8 |
| (6) | *2 | I-8 | 20.5 | 5.7 | 5.1 |
| (7) | *2 | I-9 | 19.5 | 5.5 | 5.7 |
| (8) | *2 | I-10 | 20.0 | 5.6 | 6.4 |
| (9) | *2 | I-11 | 15.0 | 4.4 | 5.3 |
| (10) | *2 | I-13 | 16.0 | 4.6 | 5.5 |
| (11) | *2 | I-5 | 17.5 | 5.0 | 7.1 |
| (12) | *2 | I-7 | 25.0 | 6.7 | 5.9 |
| (13) | *2 | I-12 | 12.5 | 3.7 | 6.8 |
| (14) | *2 | I-14 | 18.0 | 5.1 | 5.1 |
| (15) | *2 | I-27 | 16.0 | 4.7 | 5.7 |
| (16) | *2 | I-24 | 20.0 | 5.6 | 6.4 |
| (17) | *2 | I-18 | 20.5 | 5.7 | 5.3 |
| (18) | *2 | I-1 | 22.0 | 6.1 | 5.9 |
| (H1) | *1 | I-1 | 5.5 | 4.8 | 5.5 |
| (H2) | *1 | Squarium 1 | 5.5 | 4.8 | 7.1 |
| (H3) | *2 | I-1 | 22.0 | 6.1 | 5.9 |
| (H4) | *2 | Squarium 1 | 23.0 | 6.3 | 6.8 |
| (H5) | *2 | I-1 | 22.0 | 6.1 | 5.9 |
| (H6) | *2 | I-1 | 22.0 | 6.1 | 5.9 |

*1: Pulverization method

*2: Emulsion polymerization-association method

TABLE 3

| Cyan toner No. | Branched hydrocarbon Wax | Amount (mass part) | Ratio (% by mass) | Ester Wax | Amount (mass part) | Ratio (% by mass) | Ratio of total wax (% by mass) |
|---|---|---|---|---|---|---|---|
| (1) | Microcrystalline wax | 1.0 | 14 | 1-6 | 6.0 | 86 | 6.2 |
| (2) | Microcrystalline wax | 10.0 | 10.8 | 1-2 | 83.0 | 89.2 | 11.7 |
| (3) | Isoparaffin wax | 11.0 | 11.5 | 1-1 | 85.0 | 88.5 | 12.0 |

TABLE 3-continued

| Cyan toner No. | Branched hydrocarbon Wax | Amount (mass part) | Ratio (% by mass) | Ester Wax | Amount (mass part) | Ratio (% by mass) | Ratio of total wax (% by mass) |
|---|---|---|---|---|---|---|---|
| (4) | Microcrystalline wax | 9.0 | 9.8 | 1-7 | 83.0 | 90.2 | 11.5 |
| (5) | Microcrystalline wax | 12.0 | 12.6 | 1-6 | 83.0 | 87.4 | 12.0 |
| (6) | Microcrystalline wax | 10.0 | 10.8 | 2-4 | 83.0 | 89.2 | 11.7 |
| (7) | Isoparaffin wax | 11.0 | 10.9 | 2-6 | 90.0 | 89.1 | 12.6 |
| (8) | Cycloparaffin wax | 9.5 | 9.6 | 3-1 | 89.0 | 90.4 | 12.3 |
| (9) | Microcrystalline wax | 11.0 | 13.3 | 3-3 | 72.0 | 86.7 | 10.7 |
| (10) | Isoparaffin wax | 12.0 | 12.6 | 3-4 | 83.0 | 87.4 | 12.1 |
| (11) | Microcrystalline wax | 13.0 | 12.4 | 4-3 | 92.0 | 87.6 | 13.1 |
| (12) | Microcrystalline wax | 12.5 | 13.1 | 4-2 | 83.0 | 86.9 | 11.8 |
| (13) | Cycloparaffin wax | 8.5 | 9.9 | 4-6 | 77.0 | 90.1 | 11.1 |
| (14) | Microcrystalline wax | 25.0 | 23.1 | 5-2 | 83.0 | 76.9 | 13.4 |
| (15) | Isoparaffin wax | 17.0 | 19.3 | 5-3 | 71.0 | 80.7 | 11.3 |
| (16) | Microcrystalline wax | 15.0 | 15.3 | 6-1 | 83.0 | 84.7 | 12.3 |
| (17) | Microcrystalline wax | 14.0 | 13.5 | 6-2 | 90.0 | 86.5 | 12.9 |
| (18) | Microcrystalline wax | 3.5 | 4.0 | 1-6 | 84.0 | 96.0 | 11.0 |
| (H1) | — | — | — | 1-6 | 7.0 | — | 6.2 |
| (H2) | Microcrystalline wax | 1.0 | 14 | 1-6 | 6.0 | 86 | 6.2 |
| (H3) | — | — | — | 1-2 | 93.0 | — | 11.7 |
| (H4) | Microcrystalline wax | 10.0 | 10.8 | 1-2 | 83.0 | 89.2 | 11.6 |
| (H5) | Microcrystalline wax | 60.0 | 65.2 | 1-6 | 32.0 | 34.8 | 11.5 |
| (H6) | Microcrystalline wax | 0.9 | 1.0 | 1-6 | 89.0 | 99.0 | 11.3 |

SQUEARIUM 1

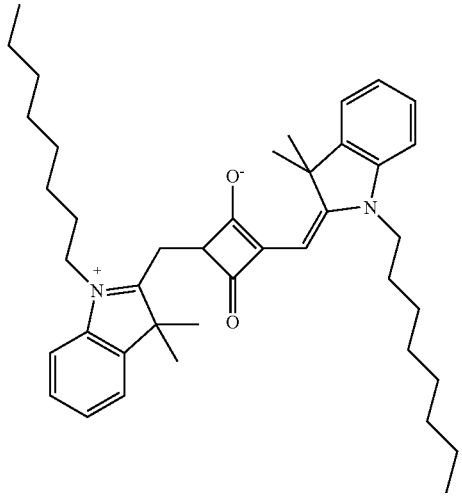

In Table 3, HNP-0190 produced by Nippon Seiro Co., Ltd. was used for the microcrystalline wax, Hi-Mic-1045 produced by Nippon Seiro Co., Ltd. was used for the isoparaffin wax, and Hi-Mic-2065 produced by Nippon Seiro Co., Ltd. was used for the cycloparaffin wax.

[Evaluation of Characteristics]

(1) Evaluation of Separation Properties

With regard to each developer, employing image forming apparatus "bizhub PRO C6500" (produced by Konica Minolta Business Technologies Inc.) and with a cyan single color mode, printing of 3,000 A4 double-sided prints of a pixel ratio of 25% was successively carried out. The obtained prints were then left stacked on the paper ejection unit. After that, sticking property and alignment property of the double-sided prints were evaluated.

A: No sticking of the double-sided prints was observed. Prints were satisfactorily aligned, and could proceed to a bookbinding step as they are.

B: No sticking of double-sided prints was observed. Prints aligning property was a little inferior, but bookbinding was possible after aligning of the prints.

C: Sticking of double-sided prints was almost negligible. Prints aligning property was poor, and it took time to align the prints.

D: Sticking of double-sided prints occurred, and when peeling the prints apart, sounds of the peeled apart process were audible. Aligning of the prints was poor, and aligning of the prints requires too much time.

(2) Evaluation of Document Offset Property

<With Respect to Images for Evaluation>

With respect to each developer, employing image forming apparatus "bizhub PRO C6500" (produced by Konica Minolta Business Technologies Inc.) and with a cyan single color mode, printing of double-sided prints having images for evaluation such as described below was carried out. On one side of a transfer paper, a yellow background image was formed, and 36 lines composed of alphabets of 6.0 points were printed using a cyan toner over the above image. On the other side of the above printed paper sheet, a magenta background image was formed, and 36 lines composed of alphabets of 6.0 points were printed over the above image using a cyan toner.

<Output Conditions of Images for Evaluation>

Fifty double-sided prints of the above images for evaluation were successively outputted. Obtained prints were placed as they were aligned on a marble table, after which, a weight was placed on the stack of prints so that a pressure corresponding to 19.2 kPa (200 g/cm$^2$) was applied on the piled up portion. The prints with the weight were allowed to stand at 30° C. and 60% RH for three days, after which the degree of image failure on the toner images having been piled up was evaluated in accordance with the criteria described below.

A (excellent): No image failure due to toner transfer and no sticking of toner images with each other were observed, and prints were at a level of absolutely no image failure.

B (good): Sounds of peeling were audible when each of piled up prints was separated, but no image failure was observed and prints were at a level of no image failure.

C (practical): Slight gloss unevenness on fixed images was observed when each of the stacked prints was separated, but no image failure was observed, and prints were judged to be at a level of few image failure.

D (failure): On the yellow or magenta background images, transfer of cyan text images was observed in a region where no text image was originally printed, and also on cyan text images, changes of color due to transfer of contacted toner images were observed.

Among the above criteria, A (excellent), B (good), and C (practical) were evaluated as acceptable.

(3) Evaluation of Gloss Unevenness

Employing image forming apparatus "bizhub PRO C6500" (produced by Konica Minolta Business Technologies Inc.), a totally solid color image containing 25% of each color was formed, and gloss unevenness generated on the image after fixing was visually observed. The results were evaluated as follows.

A: No gloss unevenness was observed.

B: Little gloss unevenness was observed, but upon closer inspection, only slight gloss unevenness can be observed.

C: By looking closely, gloss unevenness was observed.

D: Gloss unevenness was obvious.

The above results were given in Table 4.

TABLE 4

| Cyan toner No. | Circularity after association | Toner particle Diameter D50 (μm) | Evaluation: Separation property | Document offset property | Gloss unevenness |
|---|---|---|---|---|---|
| (1) | — | 6.3 | B | A | B |
| (2) | 0.968 | 6.4 | A | A | A |
| (3) | 0.941 | 5.3 | A | A | A |
| (4) | 0.943 | 7.2 | A | A | A |
| (5) | 0.970 | 6.1 | A | A | A |
| (6) | 0.940 | 5.2 | A | A | A |
| (7) | 0.958 | 6.7 | A | A | A |
| (8) | 0.951 | 6.5 | A | A | A |
| (9) | 0.943 | 7.9 | A | A | A |
| (10) | 0.971 | 6.3 | A | A | A |
| (11) | 0.943 | 6.5 | A | A | A |
| (12) | 0.951 | 5.1 | B | A | B |
| (13) | 0.943 | 5.3 | A | B | B |
| (14) | 0.971 | 7.2 | A | A | A |
| (15) | 0.951 | 6.1 | A | A | A |
| (16) | 0.943 | 5.2 | B | B | B |
| (17) | 0.971 | 6.7 | B | B | B |
| (18) | 0.961 | 6.5 | B | C | B |
| (H1) | — | 7.2 | D | D | D |
| (H2) | — | 6.1 | D | C | D |
| (H3) | 0.957 | 5.2 | D | D | D |
| (H4) | 0.943 | 6.7 | C | C | C |
| (H5) | 0.958 | 6.3 | D | D | D |
| (H6) | 0.963 | 6.7 | D | D | D |

As shown in Table 4, prints obtained by employing Cyan Toners (1) to (17), which were in the category of the present invention, exhibited excellent in any characteristics, but prints obtained by employing Comparative Cyan Toners (H1) to (H6), which are out of the category of the present invention, had problems in at least one characteristic.

What is claimed is:

1. An electrostatic latent image developing toner comprising at least a resin, a wax and a colorant, wherein the wax comprises 40 to 98% by mass of a first release agent comprising an ester wax and 2 to 60% by mass of a second release agent comprising a hydrocarbon having at least one of a branched chain structure and a cyclic structure; and the colorant comprises a silicon phthalocyanine represented by Formula (I):

Formula (I)

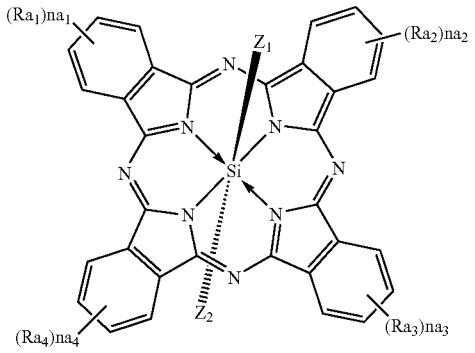

wherein $Z_1$ and $Z_2$ each independently represent a hydroxyl group, a chlorine atom, an aryloxy group of 6 to 18 carbon atoms, an alkoxyl group of 1 to 22 carbon atoms or a group represented by Formula (IV); $Ra_1$, $Ra_2$, $Ra_3$ and $Ra_4$ each independently represent a substituent; and $na_1$, $na_2$, $na_3$ and $na_4$ each independently represent an integer of 0 to 4, Formula (IV)

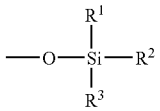

wherein $R^1$, $R^2$ and $R^3$ each represent an alkyl group of 1 to 22 carbon atoms, an aryl group of 6 to 18 carbon atoms, an alkoxyl group of 1 to 22 carbon atoms or an aryloxy group of 6 to 13 carbon atoms, wherein $R^1$, $R^2$ and $R^3$ each may be the same or different.

2. The electrostatic latent image developing toner of claim 1, wherein $Z_1$ and $Z_2$ each independently represent a group represented by Formula (IV).

3. The electrostatic latent image developing toner of claim 2, wherein $R^1$, $R^2$ and $R^3$ each are a methyl group.

4. The electrostatic latent image developing toner of claim 1, wherein a content of the wax is 4 to 25% by mass based on a total mass of the resin, the colorant and the wax.

5. The electrostatic latent image developing toner of claim 1, wherein a content of the silicon phthalocyanine is 1 to 20% by mass based on a total mass of the electrostatic latent image developing toner.

6. The electrostatic latent image developing toner of claim 1, wherein the content of the silicon phthalocyanine is 1 to 10% by mass based on the total mass of the electrostatic latent image developing toner.

7. The electrostatic latent image developing toner of claim 1, wherein the content of the silicon phthalocyanine is 1 to 7% by mass based on the total mass of the electrostatic latent image developing toner.

8. The electrostatic latent image developing toner of claim 1 comprising two or more kinds of silicon phthalocyanine.

9. The electrostatic latent image developing toner of claim 1, wherein the wax comprises 60 to 95% by mass of the first release agent and 5 to 40% by mass of the second release agent.

10. The electrostatic latent image developing toner of claim 1, wherein a ratio of branch of the hydrocarbon having the branched chain structure is 0.1 to 20%.

11. The electrostatic latent image developing toner of claim 1, wherein a ratio of branch of the hydrocarbon having the branched chain structure is 0.3 to 10%.

12. A method of image forming comprising the steps of:

forming an electrostatic latent image on a photoreceptor;

forming a toner image by developing the electrostatic latent image formed on the photoreceptor by employing a developer which is prepared by incorporating the electrostatic latent image developing toner of claim 1;

transferring the toner image formed on the photoreceptor onto a transfer body; and fixing the toner image transferred onto the transfer body, wherein a fixing device employing a contact heating method is used in the fixing step.

* * * * *